US010894552B2

(12) United States Patent
Brooks et al.

(10) Patent No.: US 10,894,552 B2
(45) Date of Patent: Jan. 19, 2021

(54) SYSTEM AND METHOD INTEGRATING AN ENERGY MANAGEMENT SYSTEM AND YARD PLANNER SYSTEM

(71) Applicant: GE Global Sourcing LLC, Norwalk, CT (US)

(72) Inventors: James D. Brooks, Schenectady, NY (US); Harry Kirk Mathews, Jr., Niskayuna, NY (US); William Schoonmaker, Melbourne, FL (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/517,889

(22) Filed: Jul. 22, 2019

(65) Prior Publication Data

US 2019/0367062 A1 Dec. 5, 2019

Related U.S. Application Data

(60) Continuation-in-part of application No. 15/992,749, filed on May 30, 2018, now Pat. No. 10,399,584, which is a continuation-in-part of application No. 15/089,574, filed on Apr. 3, 2016, now Pat. No. 10,220,864, which is a division of application No. 14/226,921, filed on Mar. 27, 2014, now Pat. No. 9,327,741.

(51) Int. Cl.
*B61L 27/00* (2006.01)
*B61L 17/00* (2006.01)

(52) U.S. Cl.
CPC ..... *B61L 27/0016* (2013.01); *B61L 17/00* (2013.01); *B61L 27/0022* (2013.01); *B61L 27/0027* (2013.01)

(58) Field of Classification Search
CPC .. B61L 27/0016; B61L 17/00; B61L 27/0022; B61L 27/0027
USPC ..... 701/19
See application file for complete search history.

(56) References Cited

U.S. PATENT DOCUMENTS 6,587,738 B1 * 7/2003 Belcea ..... B61L 27/0027 700/33
9,156,477 B2 * 10/2015 Cooper ..... B61L 3/006
(Continued)

OTHER PUBLICATIONS

Examination report No. 1 for corresponding Australian application No. 2015201381 dated Feb. 30, 2020. (4 pages).

*Primary Examiner* — Muhammad Shafi
(74) *Attorney, Agent, or Firm* — Christopher R. Carroll; The Small Patent Law Group LLC

(57) ABSTRACT

A system and method identify vehicles to be included in a multi-vehicle system that is to travel along one or more routes for an upcoming trip, and determines plural different potential builds of the multi-vehicle system. The different potential builds represent different sequential orders of the vehicles in the multi-vehicle system. The system and method also simulate travels of the different potential builds for the upcoming trip, calculate a safety metric, consumption metric, and/or build metric for the different potential builds based on travels that are simulated, and generates a quantified evaluation of the safety metric, consumption metric, and/or build metric for the different potential builds for use in selecting a chosen potential build of the different potential builds. The chosen potential build is used to build the multi-vehicle system for the upcoming trip.

20 Claims, 8 Drawing Sheets

(56) References Cited

U.S. PATENT DOCUMENTS

| | | | | |
|---|---|---|---|---|
| 2005/0279242 | A1* | 12/2005 | Maier | B60L 7/04 105/26.05 |
| 2007/0219681 | A1* | 9/2007 | Kumar | B61L 3/006 701/19 |
| 2009/0187291 | A1* | 7/2009 | Daum | B61L 3/006 701/2 |
| 2011/0210867 | A1* | 9/2011 | Benedikt | G08G 1/01 340/905 |
| 2012/0277940 | A1* | 11/2012 | Kumar | B61L 27/0027 701/20 |
| 2013/0144670 | A1* | 6/2013 | Kickbusch | G06Q 10/06 705/7.12 |
| 2013/0171590 | A1* | 7/2013 | Kumar | B61L 3/006 434/62 |
| 2014/0094998 | A1* | 4/2014 | Cooper | B61L 3/006 701/2 |
| 2014/0330460 | A1* | 11/2014 | Schoonmaker | B61C 17/12 701/19 |

* cited by examiner

SYSTEM AND METHOD INTEGRATING AN ENERGY MANAGEMENT SYSTEM AND YARD PLANNER SYSTEM

CROSS-REFERENCE TO RELATED APPLICATIONS

This application is a continuation-in-part of, and claims priority to, U.S. patent application Ser. No. 15/992,749, filed on 30 May 2018, which is a continuation-in-part of, and claims priority to, U.S. patent application Ser. No. 15/089,574, filed on 3 Apr. 2016 (now U.S. Pat. No. 10,220,864), which is a divisional of and claims priority to U.S. patent application Ser. No. 14/226,921, filed on 27 Mar. 2014 (now U.S. Pat. No. 9,327,741). The entire disclosures of these patent applications are incorporated herein by reference.

BACKGROUND

Technical Field

The subject matter described herein relates to vehicle systems formed from multiple vehicles.

Discussion of Art

A transportation network for vehicle systems can include several interconnected main routes on which separate vehicles travel between locations to deliver or receive payloads. For example, a transportation network may be formed from interconnected railroad tracks with rail vehicles traveling along the tracks. The vehicles may travel according to schedules that dictate where and when the vehicles are to travel within the transportation network. The schedules may be coordinated with each other to arrange for certain vehicles to arrive at various locations in the transportation network at desired times and/or in a desired order.

The transportation network may include a vehicle yard or route hub, such as a rail yard or a distribution warehouse that includes a relatively dense grouping of routes or locations where several vehicles can congregate, deliver payloads, receive new payloads, perform maintenance, refuel, or the like. While in the vehicle yard, vehicles are assigned or paired with payloads based on power or ability of the vehicle to pull to carry the payload regardless on the overall energy or emission efficiency of available vehicles or the availability of vehicles in other vehicle yards within the transportation network.

BRIEF DESCRIPTION

In one embodiment, a method includes identifying vehicles to be included in a multi-vehicle system that is to travel along one or more routes for an upcoming trip, determining plural different potential builds of the multi-vehicle system, the different potential builds representing different sequential orders of the vehicles in the multi-vehicle system, simulating travels of the different potential builds of the multi-vehicle system over the one or more routes of the upcoming trip, calculating one or more safety metrics, consumption metrics, or build metrics for the different potential builds of the multi-vehicle system based on travels of the different potential builds that are simulated, and generating a quantified evaluation of the one or more safety metrics, consumption metrics, or build metrics for the different potential builds of the multi-vehicle system for use in selecting a chosen potential build of the different potential builds. The chosen potential build is used to build the multi-vehicle system for the upcoming trip.

In one embodiment, a system includes one or more processors configured to identify vehicles to be included in a multi-vehicle system that is to travel along one or more routes for an upcoming trip. The one or more processors also are configured to determine plural different potential builds of the multi-vehicle system. The different potential builds represent different sequential orders of the vehicles in the multi-vehicle system. The one or more processors are configured to calculate one or more safety metrics, consumption metrics, or build metrics for the different potential builds of the multi-vehicle system based on simulated travels of the different potential builds. The one or more processors also are configured to generate a quantified evaluation of the one or more safety metrics, consumption metrics, or build metrics for the different potential builds of the multi-vehicle system for use in selecting a chosen potential build of the different potential builds. The chosen potential build is used to build the multi-vehicle system for the upcoming trip.

In one embodiment, a method includes identifying vehicles to be included in a multi-vehicle system that is to travel along one or more routes for an upcoming trip, and determining plural different potential builds of the multi-vehicle system. The different potential builds represent different sequential orders of the vehicles in the multi-vehicle system. The method also includes calculating one or more safety metrics, consumption metrics, or build metrics for the different potential builds of the multi-vehicle system based on simulated travel of the different potential builds, and generating a quantified evaluation of the one or more safety metrics, consumption metrics, or build metrics for the different potential builds of the multi-vehicle system for use in selecting a chosen potential build of the different potential builds. The chosen potential build is used to build the multi-vehicle system for the upcoming trip.

In one embodiment, a method includes determining (using one or more processors) route components to be modified (e.g., in need of repair and/or upgrading) within a transportation network, determining (using the one or more processors) an amount of available resources to complete modification of one or more of the route components, and determining (using the one or more processors) different combinations of modifications to one or more of the route components. Each of the different combinations of modifications is associated with costs that are no greater than the amount of available resources. The method also includes simulating (using the one or more processors) travel of one or more vehicle systems in the transportation network according to the different combinations of modifications and selecting at least one of the different combinations of modifications as a selected modification combination. One or more of the route components are modified according to the selected modify combination.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
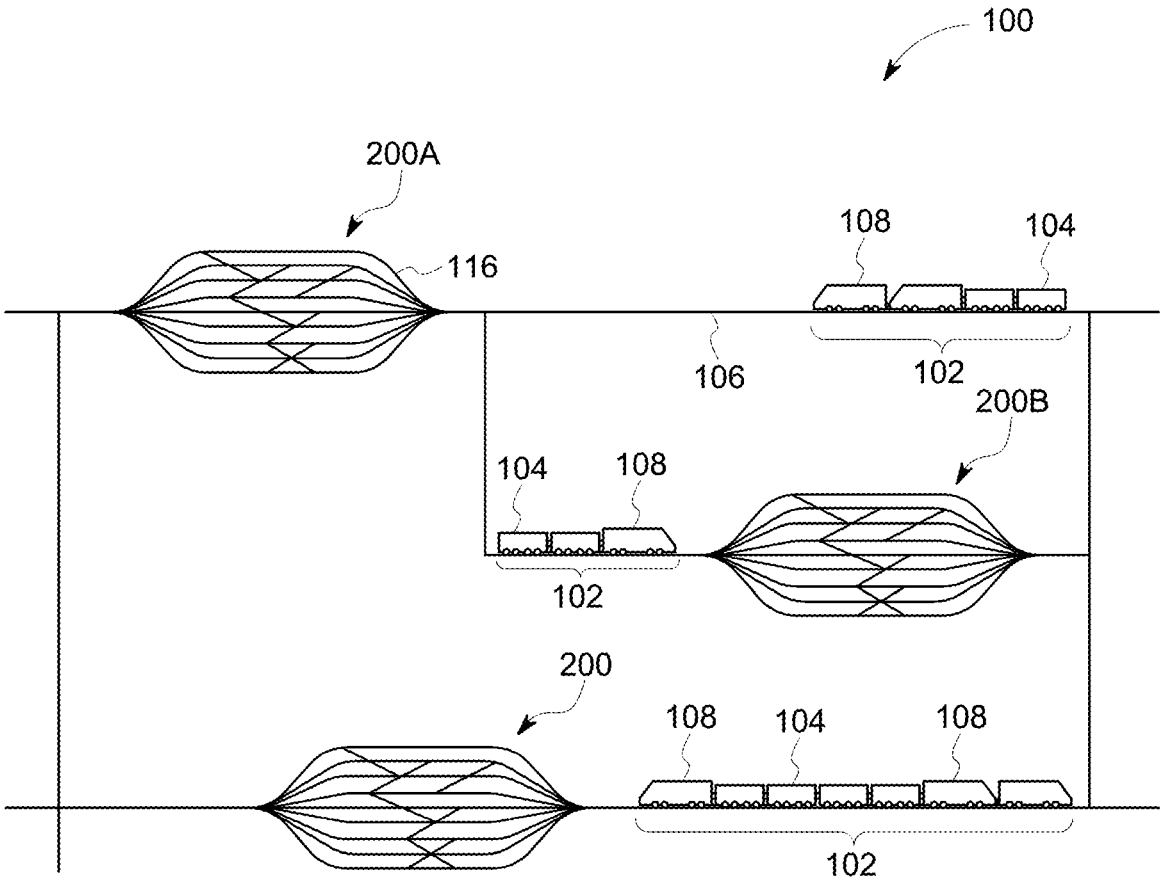
FIG. 1 is a schematic diagram of a transportation network of an embodiment.

One or more embodiments herein described provide systems and methods for coordinating a selection of one or more propulsion-generating vehicles (PGV) for forming a vehicle system having one or more cargo-carrying vehicles (CCV). A CCV optionally can be referred to as a non-propulsion-generating vehicle. The PGV may be traveling to (e.g., heading inbound to) a vehicle yard (e.g., for repair and/or maintenance of the PGV, to obtain additional fuel, to unload cargo and/or CCV off of another vehicle system, to load cargo and/or CCV onto the PGV to form the vehicle system, to sort the PGV among other PGV, or the like) or be stored within or at the vehicle yard. The vehicle yard may act as a transportation hub within a transportation network, such as when the vehicle yard is coupled with several routes extending away from the vehicle yard for the vehicle system to travel along to reach other destinations. The vehicle yard may be a final destination location of a trip of the vehicle system, or may be an intermediate location as a stopping off point when the vehicle system is traveling to another business destination (e.g., the destination to which the vehicle system is contracted to travel).

A vehicle yard can refer to a grouping of interconnected routes at a central location or relatively close to each other and/or where several vehicles can concurrently stop for maintenance, refueling, re-ordering of the vehicles relative to each other, or the like. Examples of vehicle yards may include, but are not limited to, interconnected railroad tracks at rail yards, airline routes condensing at hubs (e.g., airports), truck routes at distribution centers, shipping routes converging at waterways or ports, or the like.

The vehicle yard may have a capacity to receive vehicle systems into the vehicle yard. This capacity can be a space limitation on the number of vehicle systems that can exit off of a main line route into the vehicle yard. Additionally or alternatively, the capacity can be a throughput limitation on the number of vehicle systems that the vehicle yard can partition (e.g., removing or separating the CCV or PGV from the vehicle system) or form (e.g., coupling the CCV or PGV into the vehicle system). As vehicle systems come and go from the vehicle yard, the availability or amount of PGV to select from to form alternative configurations of the vehicle systems with the one or more CCV changes. The travel and/or amount of the vehicle systems into the vehicle yard may be controlled such that the vehicle system arrives at the vehicle yard when the vehicle yard has sufficient capacity (e.g., space) to receive the vehicle system. Alternatively, in an embodiment, the vehicle system may be instructed to slow down as the vehicle system is traveling toward the vehicle yard, due to capacity restraints of the vehicle yard, so that an alternative vehicle system having a higher priority, respectively, may arrive or be received into the vehicle yard. The vehicle system may be instructed to slow down when doing so does not have a significantly negative impact (e.g., the impact is below a designated threshold) on the flow of traffic within a transportation network formed from interconnected routes, including the route on which the vehicle travels toward the vehicle yard.

While the discussion and figures included herein may be interpreted as focusing on rail yards as vehicle yards and rail vehicle consists (e.g., trains) as the vehicle systems, it should be noted that not all embodiments of the subject matter herein described and claimed herein are limited to rail yards, trains, and railroad tracks. (A consist is a group of vehicles that are mechanically linked to travel together.) The inventive subject matter may apply to other vehicles, such as airplanes, ships, or automobiles or the like. For example, one or more embodiments may select which airplane is selected to depart with a payload from an airport, a shipping facility (e.g., where the airplane drops off and/or receives cargo for delivery elsewhere), a repair or maintenance facility, or the like. Other embodiments may apply to control which ship is selected to depart with a payload from a ship yard or dock, which semi or delivery truck departs a repair facility, a shipping or distribution facility (e.g., where the automobile picks up and/or drops off cargo to be delivered elsewhere), or the like.

Not all embodiments of the subject matter described herein are limited to vehicle systems formed from multiple vehicles that are mechanically coupled with each other. Some embodiments may relate to vehicle systems formed from two or more vehicles mechanically joined with each other by a coupler or other mechanical apparatus, while other embodiments may relate to vehicle systems formed from two or more vehicles that are logically, but not mechanically, joined with each other. For example, a vehicle system can be formed from two or more vehicles that are separate from each other and not mechanically connected, but that communicate with each other to coordinate the separate movements of the vehicles so that the vehicles travel together (e.g., in a convoy) as the vehicle system.

FIG. 1 is a schematic diagram of an embodiment of a transportation network 100. The transportation network 100 includes a plurality of interconnected routes 106, such as railroad tracks, roads, ship lanes, or other paths across which a vehicle system 102 travels. The routes 106 may be referred to as main line routes when the routes 106 provide paths for the vehicle systems 102 to travel along to travel between a starting location and a destination location (and/or to one or more intermediate locations between the starting location and the destination location). The transportation network 100 may extend over a relatively large area, such as hundreds of square miles or kilometers of area. While only one transportation network 100 is shown in FIG. 1, one or more other transportation networks 100 may be joined with and accessible to vehicles traveling in the illustrated transportation network 100. For example, one or more of the routes 106 may extend to another transportation network 100 such that vehicles can travel between the transportation networks 100. Different transportation networks 100 may be defined by different geographic boundaries, such as different towns, cities, counties, states, groups of states, countries, continents, or the like. The number of routes 106 shown in FIG. 1 is meant to be illustrative and not limiting on embodiments of the described subject matter. Moreover, while one or more embodiments described herein relate to a transportation network formed from railroad tracks, not all embodiments are so limited. One or more embodiments may relate to transportation networks in which vehicles other than rail vehicles travel, such as flights paths taken by airplanes, roads or highways traveled by automobiles, water-borne shipping paths (e.g., shipping lanes) taken by ships, or the like.

Several vehicle systems 102 travel along the routes 106 within the transportation network 100. The vehicle systems 102 may concurrently travel in the transportation network 100 along the same or different routes 106. Travel of one or more vehicle systems 102 may be constrained to travel within the transportation network 100. Alternatively, one or more of the vehicle systems 102 may enter the transportation network 100 from another transportation network or leave the transportation network 100 to travel into another transportation network. In the illustrated embodiment, the vehicle systems 102 are shown and described herein as rail vehicles or rail vehicle consists. However, one or more other embodiments may relate to vehicles other than rail vehicles or rail vehicle consists. For example, the vehicle systems can represent other off-highway vehicles (e.g., vehicles that are not designed or permitted to travel on public roadways), marine vessels, airplanes, automobiles, and the like. While three vehicle systems 102 are shown in FIG. 1, alternatively, a different number of vehicle systems 102 may be concurrently traveling in the transportation network 100 (e.g., more than three, less than three).

Each vehicle system 102 may include one or more PGV 108 (e.g., locomotives or other vehicles capable of self-propulsion) and/or one or more CCV 104. The CCV 104 is a non-propulsion-generating vehicle, such as cargo cars, passenger cars, or other vehicles incapable of self-propulsion. The PGV 108 and the CCV 104 are mechanically coupled or linked together forming a vehicle system 102 (e.g., a consist) to travel or move along the routes 106. The routes 106 are interconnected to permit the vehicle systems 102 to travel over various combinations of the routes 106 to move from a starting location to a destination location and/or an intermediate location there between.

Figure 2:
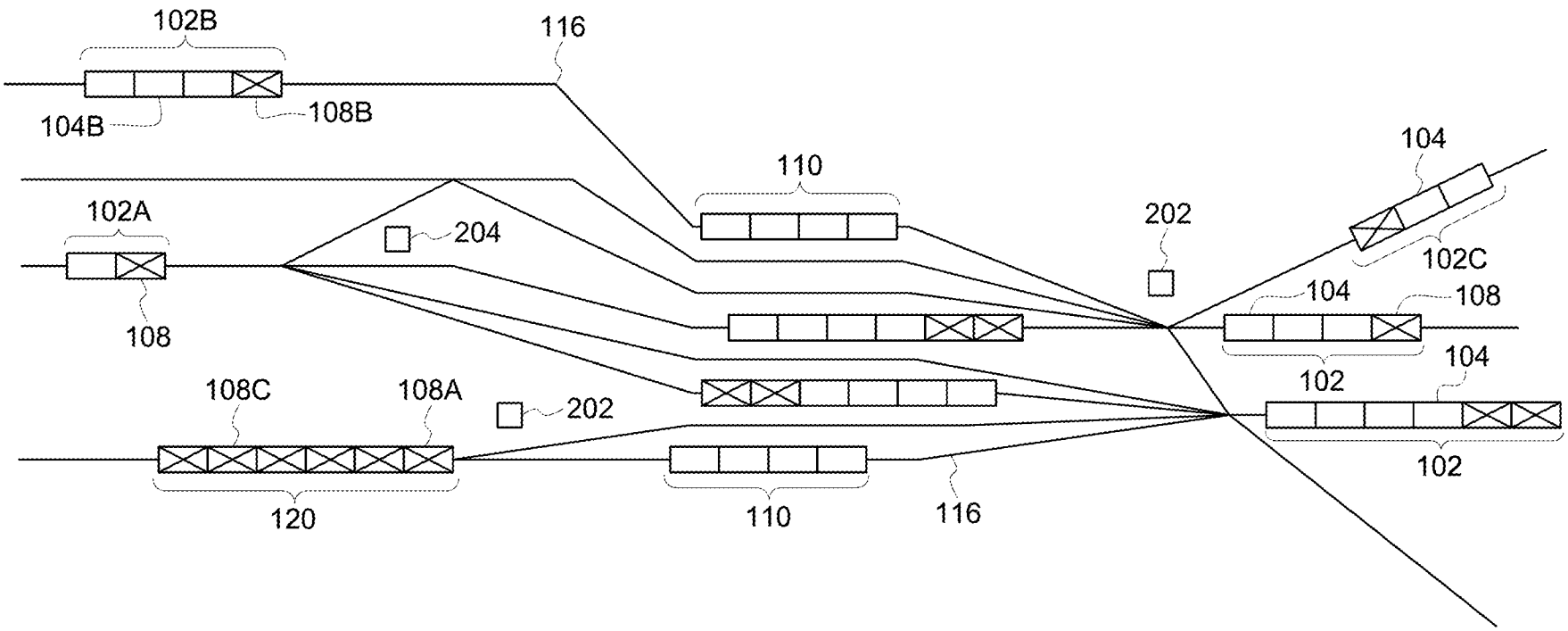
FIG. 2 is a schematic diagram of a vehicle yard in accordance with an embodiment.

The transportation network 100 includes one or more vehicle yards 200. While three vehicle yards 200 are shown, alternatively, the transportation network 100 may include a different number of vehicle yards 200. FIG. 2 is a schematic diagram of a vehicle yard 200 of the transportation network 100 having a control system 150 in accordance with an embodiment. The vehicle yard 200 is shown with a plurality of interconnected routes 116 that are located relatively close to each other. For example, the routes 116 in the vehicle yard 200 may be closer together (e.g., less than 10, 20, or 30 feet or meters between nearby routes 116) than the routes 106 outside of the vehicle yards 200 (e.g., more than several miles or kilometers between nearby routes 106). The number of interconnected routes 116 shown in FIG. 2 is meant to be illustrative and not limiting on embodiments of the described subject matter.

The vehicle yards 200 are located along the routes 106 in order to provide services to the vehicle systems 102, such as to repair or maintain the one or more PGV 108 (illustrated as a rectangle with an X in FIG. 2), re-order the sequence of vehicle systems 102 traveling along the routes 106 by adjusting an order to which the vehicle systems 102 exits the vehicle yard 200 relative to the order of the vehicle systems 102 entering vehicle yard 200, partitioning and storing the one or more PGV 108 and/or CCV 104 (illustrated as a rectangle in FIG. 2) of the vehicle system 102, load or couple additional CCV 104 and/or PGV 108 onto the vehicle system 102, or the like. In an embodiment, the vehicle yards 200 are not used as routes to travel from a starting location to a destination location. For example, the vehicle yards 200 may not be main line routes along which the vehicle systems 102 travel from a starting location to a destination location. Instead, the vehicle yards 200 may be connected with the routes 106 to allow the vehicle systems 102 to get off of the main line routes 106 for services described above.

Figure 3:
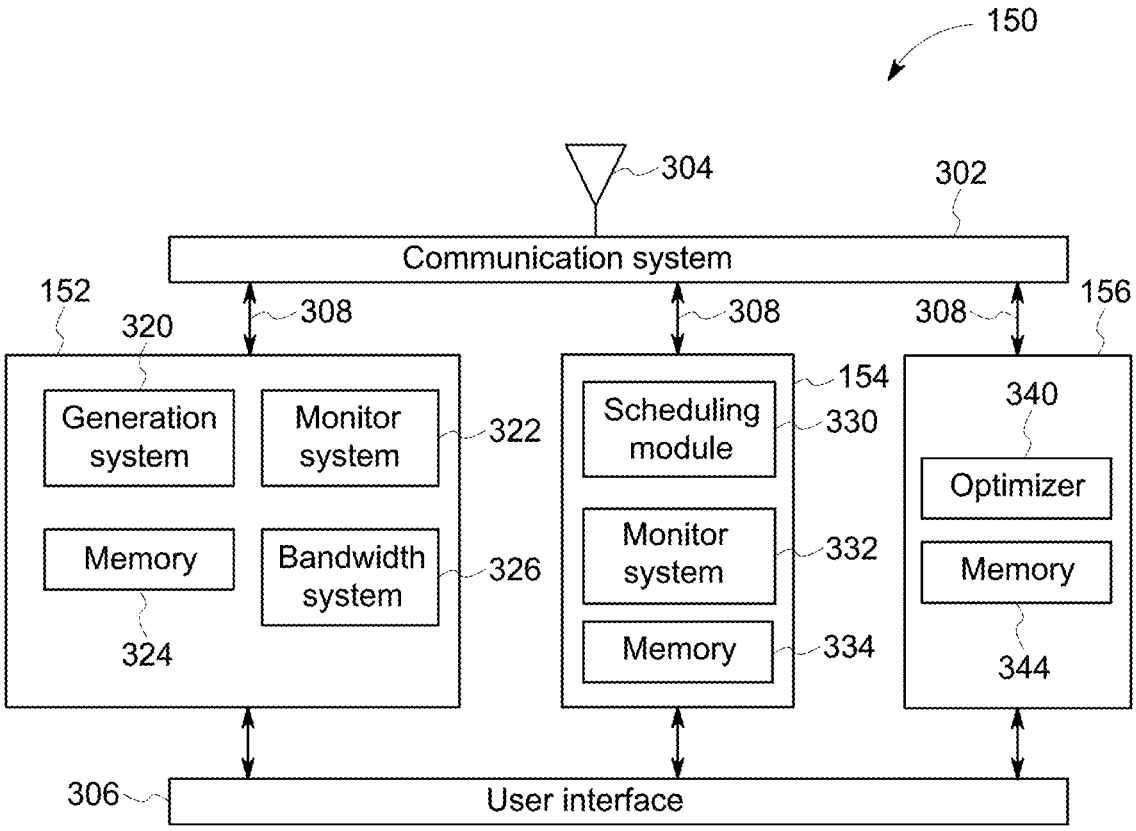
FIG. 3 is a simplified block diagram of an embodiment of a control system.

The services and operations of the rail yard 200 are controlled by the control system 150. The control system 150 includes various systems that perform operations within the vehicle yard 200. For example, as illustrated in FIG. 3, the control system 150 may include a communication system 302, a user interface 306, a yard planner system 152, a scheduling system 154, and an energy management system 156. The yard planner system 152 manages the planned activities within the vehicle yard 200, such as, processing operations that are scheduled to be performed on one or more PGV 108 and/or CCV 104 within the vehicle system 102, receiving the vehicle systems 102 into the yard 200, moving the vehicles (e.g., PGV 108, CCV 104, vehicle systems 102) through the yard 200 (including performing maintenance, inspection, cleaning, loading/unloading of cargo, or the like), and preparing or coupling the one or more PGV 108 and CCV 104 for departing the yard by forming vehicle systems 102 (e.g., consists) which may or may not be the same vehicle system 102 in which the CCV 104 and PGV 108 arrived into the vehicle yard 200. The scheduling system coordinates movement of the vehicle systems 102 within the transportation network 100. The energy management system 156 determines a vehicle configuration for one or more, or each, of the vehicle systems 102. The vehicle configuration can represent a set of one or more selected PGV 108 to be included in the vehicle system 102.

The systems described herein (e.g., systems included in the control system 150 and external to the control system 150) may include or represent hardware and associated instructions (e.g., software stored on a tangible and non-transitory computer readable storage medium (e.g., memory 324, 334 and 344), such as a computer hard drive, ROM, RAM, or the like) that perform the operations described herein. The hardware may include electronic circuits that include and/or are connected to one or more logic-based devices, such as microprocessors, processors, controllers, or the like. These devices may be off-the-shelf devices that perform the operations described herein from the instructions described above. Additionally or alternatively, one or more of these devices may be hard-wired with logic circuits to perform these operations. Two or more of the systems may share one or more electronic circuits, processors, and/or logic-based devices. In one or more embodiments, the systems described herein may be understood as including or representing electronic processing circuitry such as one or more field programmable gate arrays (FPGA), application specific integrated circuits (ASIC), or microprocessors. The systems may be configured to execute one or more algorithms to perform functions described herein. The one or more algorithms may include aspects of embodiments disclosed herein, whether or not expressly identified in a flowchart or as a step or operation of a method. Various embodiments described herein may be characterized as having different systems/elements (e.g., modules) that include one or more processors. However, it should be noted that the one or more processors may be the same processor or different processors (e.g., each system/element implemented in a separate processor(s), the system/elements all implemented in the same processor(s), or some systems/elements in the same processor(s), and others in different processor(s)).

The yard planner system 152 may include a monitoring system 322. The monitoring system may obtain input information used by the yard planner system 152 to create the yard plans and monitor the yard state information of the vehicle yard 200 and the vehicles (e.g., vehicle systems 102, CCV 104, PGV 108) within the yard 200.

The yard state information may indicate the status of the different vehicles (e.g., vehicle system 102, CCV 104, PGV 108) within the vehicle yard 200, such as where the vehicles currently are located, where the vehicles are expected (e.g., scheduled) to be located at a future time period, what operations are being performed on the vehicles, what resources (e.g., equipment, tools, personnel, or the like) are being expended or used to perform the operations on the vehicles, or the like. The yard state information may be obtained by the monitoring system 322 using messaging (e.g. peer-to-peer messaging) with management information systems, such as system-wide vehicle inventory management systems (that monitor which vehicles are in the yard and/or locations of the vehicles as the vehicles move through the yard), through direct data entry by the operators via the user interface 306. For example, the monitoring system 322 may receive the yard state information from the operator using yard workstations 202 such as computer workstations, tablet computers, mobile phones, and/or other devices through the communication system 302. Additionally or alternatively, some of the yard state information may be received, via the communication system 302, from one or more yard sensors 204 (e.g., include transponders, video cameras, track circuits, or the like) that measure or otherwise obtain data indicative of the yard state information.

Input information may include vehicle connection plans based on a priority and/or selection requests (e.g., for the vehicle system 102, CCV 104, PGV 108) received from the operator (e.g., using the user interface 306) and/or the energy management system 156, the destination locations (e.g., of the vehicle system 102, CCV 104, PGV 108) received from the operator and/or the scheduling system 154, or the like. A vehicle connection plan identifies one or more CCV 104 and/or one or more PGV 108 to be included or coupled to an outbound vehicle system 102 (e.g., vehicle 102 leaving the vehicle yard 200). Additionally or alternatively, the input information may include primary and secondary vehicle connection plans. The secondary vehicle connection plan may represent one or more additional output vehicle systems 102 that the one or more CCV 104 and/or the one or more PGV 108 may be coupled to or included to if the primary vehicle connection plan is unattainable. Optionally, the vehicle connection plans may include an order, priority list, or timing deadlines, related to the completion of the vehicle connection plan. In an embodiment the priority of the vehicle connection plan correlates to a priority of the vehicle system 102, CCV 104, and/or PGV 108 described below. The priority of the vehicle connection plan instructs the yard planner system 152 on the order of which vehicle system 102 relative to the other vehicle systems to be completed in the yard plan. Optionally, the yard planner system 152 may automatically transmit or signal to the operator within the vehicle yard 200 to direct the coupling to complete the vehicle connection plan of the one or more PGV with the CCV.

For example, the vehicle system 102B enters into the vehicle yard 200 having the CCV 104B. The yard planner system 152 receives input information from the scheduling system 154 that the CCV 104B is scheduled for a different destination location than the destination location of the vehicle system 102B. In order to ensure that the vehicle system 102B and CCV 104B reach the appropriate destination locations, the monitoring system 322 may match an outgoing vehicle system to the CCV 104B having similar destination locations or using the destination location of the outgoing vehicle system as the intermediate location for the CCV 104B. To determine a match, the monitoring system 322 may track the scheduled outbound destination locations of different vehicle systems 102 currently within the vehicle yard 200 or entering the vehicle yard 200 within a predetermined future time period (e.g., two hours before the predetermined departure time of the CCV 104B) by analyzing movement plans or schedule of the vehicle systems 102 from the scheduling system 154. Once the outgoing vehicle system is selected or matched, the yard planner system 152 may create a yard plan or modify an existing yard plan to decouple or partition the CCV 104B from the vehicle system 102B and couple the CCV 104B to the matched outgoing vehicle system.

Additionally or alternatively, if the matched outgoing vehicle system, determined by the monitoring system 322, is not within the vehicle yard 200 (e.g., the matched outgoing vehicle system is not in the yard or is not arriving within a predetermined future time period), the yard planner system 152 may create and/or modify the yard plan to decouple or partition the CCV 104B from the vehicle system 102B and couple the CCV 104B to a CCV group 110 to await coupling with the matched outgoing vehicle system and/or one or more PGV 108 to form the matched outgoing vehicle system. The CCV group 110 may be formed of one or more CCV 104 based on the predetermined departure time of the CCV 104, the destination location or intermediate location of the CCV 104, the type of payload within the CCV 104, selection by the operator of the vehicle yard 200, priority of the CCV 104, communication by a remote vehicle yard, or the like.

In an embodiment, the yard plan may be later modified or adjusted by the yard planning system 152 after the monitoring system 322 receives a PGV change request by the energy management system 156. For example, the monitoring system 322 receives the PGV change request from the energy management system 156 instructing that the vehicle system 102B should be coupled to the PGV 108A and not PGV 108B (e.g., the PGV 108B should be partitioned from the vehicle system 102B). The yard planning system 152 may modify or adjust the yard plan to partition the PGV 108B from the vehicle system 102B and couple the PGV 108A to the vehicle system 102B.

A bandwidth system 326 of the yard planner system 152 monitors constraints on the processing operations that are performed on one or more of the vehicles within the vehicle yard 200 to move the vehicle systems into, through, and out of the vehicle yard 200. The bandwidth system 326 may receive data representative of the processing constraints from one or more of the operators, sensors 204, or the like, to track and/or update the processing constraints over time. The yard plans that are generated by the yard planner system 152 may be updated when the processing constraints change or significantly change such as from route configurations, vehicle inventory, route maintenance, or the like.

For example, the bandwidth system 326 may track route configurations in the yard 200. The route configuration includes the layout (e.g., arrangement, orientations, allowed directions of travel, intersections, or the like) of routes 116 (e.g., tracks) within the vehicle yard 200 on which the vehicles travel and/or are processed in the yard 200. The route configuration also can include the capacities of the routes 116 within the yard 200, such as the sizes of the routes 116 (e.g., lengths). Larger (e.g., longer) stretches of the routes 116 have a larger capacity for receiving vehicles than smaller (e.g., shorter) stretches of the routes 116. These capacities can change with respect to time as the number of vehicles in the yard 200 (and on the routes 116) changes, as segments of the route 116 are unavailable due to maintenance or repair, as segments of the routes 116 become available after being unavailable due to maintenance or repair, or the like.

As another example of processing constraints that can be monitored, the bandwidth system 326 may track vehicle inventories in the vehicle yard 200. Vehicle inventories can represent the locations of various (or all) of the vehicle systems 102, PGV 108 and/or CCV 104 within the vehicle yard 200, the intended (e.g., scheduled) locations and/or routes that the vehicles are to occupy and/or travel along in the vehicle yard 200, the current and/or future (e.g., scheduled) status of the processing operations being performed on the various vehicles in the yard, or the like.

A generation system 320 of the yard planner system 152 plans movements of vehicles through the yard and processing activities to be performed on the vehicles to create the yard plan. As described above, the yard plan is a schedule of movements of the vehicles (e.g., vehicle systems 102, CCV 104, PGV 108) through different locations and/or along different routes 116 within the yard 200, as well as a schedule of processing operations to be performed on or with the vehicles at various locations of the vehicles, as the vehicles move from an inbound consist to an outbound consist.

The monitoring system 322 and/or bandwidth system 326 may obtain the information described above via the communication system 302 coupled to or wirelessly communicating with the yard planner system 152. The communication system 302 may include electronic circuitry and other hardware that communicates data signals with the scheduling system 154, the energy management system 156, remote control systems, the yard sensors 204, and/or the yard workstations 202. For example, the communication system 302 may include one or more antennas 304 for wirelessly communicating with the remote control systems, sensors 204, and/or workstations 202. Additionally or alternatively, the communication system 302 may be coupled with conductive communication pathways 308, such as one or more cables, busses, wires, rails, or the like, through which the information can be communicated with, for example, the yard planner system 152, the scheduling system 154, the energy management system 156, the yard sensors 204, and/or the yard workstations 202. As described below, the communication system 302 may send data signals to one or more of the yard workstations 202 in order to visually present the yard 200 to users of the workstations 202.

The scheduling information obtained by the yard planner system 152 may describe the intended routing and arrival and/or departure times of the vehicle system 102, CCV 104, and/or PGV 108 within the transportation network 100. The scheduling information or the movement plan may be determined or created by the scheduling system 154 coordinating the schedules of the various vehicle traveling within the transportation network 100 and through the vehicle yards 200. The movement plan may include the origin location of the vehicle system 102, CCV 104, and/or PGV 108, the destination location, and/or intermediate locations (e.g., vehicle yards 200). Additionally, the movement plan may list the vehicle yards 200 that the vehicles are to travel to and enter in during each portion (e.g., leg) of travel of the vehicles from the origin location to the respective destination locations. The scheduling system 154 may be disposed at a central dispatch office, within the vehicle yard 200, and/or within the vehicle system 102. The scheduling system 154 may create and communicate the scheduling information to one or more vehicle systems 102, the yard planner system 152, the energy management system 156, or the like through the communication system 302 using a wireless connection (e.g., radio frequency (RF)) or via the conductive communication pathway 308.

The scheduling system 154 includes several modules that perform various operations or functions described herein. The modules may include hardware and/or software systems that operate to perform one or more functions, such as one or more computer processors and/or one or more sets of instructions. The modules shown in FIG. 3 may represent the hardware (e.g., a computer processor) and/or software (e.g., one or more sets of instructions such as software applications or hard-wired logic) used to perform the functions or operations associated with the modules. A single hardware component (e.g., a single processor) and/or software component may perform the operations or functions of several modules, or multiple hardware components and/or software components may separately perform the operations or functions associated with different modules. The instructions on which the hardware components operate may be stored on a tangible and non-transitory (e.g., not a transient signal) computer readable storage medium, such as a memory 334. The memory 334 may include one or more computer hard drives, flash drives, RAM, ROM, EEPROM, or the like. Alternatively, one or more of the sets of instructions that direct operations of the hardware components may be hard-wired into the logic of the hardware components, such as by being hard-wired logic formed in the hardware of a processor or controller.

The scheduling system 154 may include a scheduling module 330 that creates schedules for the vehicle systems 102 within the transportation network 100 and the vehicle yards 200. The scheduling module 330 may form the movement plan, for example, by generating schedules for the vehicle systems 102 that are based (at least in part) on capacities of the vehicle yards 200 (shown in FIG. 2) to receive incoming vehicle systems 102. The scheduling module 330 may delay a scheduled arrival time for a vehicle system 102 to arrive at a vehicle yard 200 if doing so does not have a significant negative impact on the flow of traffic in the transportation network 100. For example, the scheduling module 330 may delay an arrival time of a vehicle system 102 such that delaying the arrival time does not decrease a throughput parameter of the transportation network 100 below a predetermined threshold.

The throughput parameter may represent the flow, rate, or movement of the vehicle systems 102 traveling through the transportation network 100 or a subset of the transportation network 100 (e.g., the vehicle yard 200, segment of the route 106). In an embodiment, the throughput parameter may indicate how successful the vehicle systems 102 are in arriving at the destination location or intermediate location according with respect to the schedule or movement plan associated with each vehicle system 102. For example, the throughput parameter may be a statistical measure of adherence of the vehicle systems 102 to the schedules of the vehicle systems 102 within the movement plan. The term "statistical measure of adherence" may refer to a quantity that is calculated for a vehicle system 102 indicating how closely the vehicle system 102 is following the schedule associated with the vehicle system 102. Further, several statistical measures of adherence to the movement plan may be calculated for more than one or various vehicle systems 102 traveling within the transportation network 100.

The monitoring module 332 may determine the throughput parameters for the transportation network 100, or an area thereof, based on the statistical measures of adherence associated with the vehicle systems 102. For example, a throughput parameter may be an average, median, or other statistical calculation of the statistical measures of adherence for the vehicle systems 102 concurrently traveling in the transportation network 100. The throughput parameter may be calculated based on the statistical measures of adherence for all, substantially all, a supermajority, or a majority of the vehicle systems 102 traveling in the transportation network 100.

The scheduling system 154 may include a monitoring module 332 which monitors travel of the vehicle systems 102 within the transportation network 100 (shown in FIG. 1) and/or capacities of the vehicle yards 200 over time. The vehicle systems 102 may periodically report current positions of the vehicle system 102 to the scheduling system 154 (and/or other information such as route and speed) so that the monitoring module 332 may track where the vehicle systems 102 are located over time. Alternatively, signals or other sensors disposed alongside the routes 106 and 116 of the transportation network 100 may periodically report the passing of vehicle system 102 by the signals or sensors to the scheduling system 152. Optionally, the monitoring module 332 may track the capacities of the vehicle yards 200 (shown in FIG. 2) by monitoring how many vehicle systems 102 enter and how many vehicle systems 102 leave each of the vehicle yards 200. Additionally or alternatively, the monitoring system 322 may receive vehicle connection plan status updates from the yard planner system 152 relating to the position or estimate of when the vehicle system 102 may leave the vehicle yard 200.

The monitoring module 332 may determine the throughput parameters of the transportation network 100 (shown in FIG. 1) and/or areas of the transportation network 100 that are used by the scheduling module 330. The monitoring module 332 may calculate the throughput parameters based on the schedules of the vehicle systems 102 and deviations from the schedules by the vehicle systems 102. For example, to determine a statistical measure of adherence to the schedule associated with the vehicle system 102, the monitoring module 332 may monitor how closely the vehicle system 102 adheres to the schedule (e.g., arrival times of the vehicle system 102 at a destination or intermediate location compared to the scheduled arrival time) as the vehicle system 102 travels within the transportation network 100.

The vehicle system 102 may adhere to the schedule of the vehicle system 102 by proceeding along a path on the route 106 toward the scheduled destination or intermediate location such that the vehicle system 102 will arrive at the scheduled location at the scheduled arrival time or within a predetermined time buffer of the scheduled arrival time. For example, an estimated time of arrival (ETA) of the vehicle system 102 may be calculated as the time that the vehicle system 102 will arrive at the scheduled destination or intermediate location if no additional anomalies (e.g., mechanical failures, route damage, route traffic, waiting for vehicle connection plan at the vehicle yard 200, or the like) occur that changes the speed or departure from an intermediate location (e.g., vehicle yard 200) at which the vehicle system 102 travels. If the ETA is the same as or within a predetermined time buffer the scheduled arrival time, then the monitoring module 332 may calculate a large statistical measure of adherence for the vehicle system 102. As the ETA differs from the scheduled arrival time (e.g., by occurring after the scheduled arrival time), the statistical measure of adherence may decrease.

Additionally or alternatively, the vehicle system 102 may adhere to the schedule by arriving at or passing through scheduled waypoints of the schedule at scheduled times that are associated with the waypoints, or within the predetermined time buffer of the scheduled times. As differences between actual times that the vehicle system 102 arrives at or passes through the scheduled waypoints and the associated scheduled times of the waypoints increases, the statistical measure of adherence for the vehicle system 102 may decrease. Conversely, as these differences decrease, the statistical measure of adherence may increase.

The monitoring module 332 may calculate the statistical measure of adherence as a time difference between the ETA of the vehicle system 102 and the scheduled arrival time of the schedule associated with the vehicle system 102. Alternatively, the statistical measure of adherence for the vehicle system 102 may be a fraction or percentage of the scheduled arrival time. For example, the statistical measure of adherence may be the difference between the ETA and the scheduled arrival time over the scheduled arrival time. Optionally, the statistical measure of adherence may further include the ETA of the vehicle system 102 to a number of scheduled waypoints (e.g., between the origin location and/or intermediate locations and the destination location) along the path of the movement plan for the vehicle system 102 and the scheduled arrival time. Alternatively, the statistical measure of adherence may be a sum total, average, median, or other calculation of time differences between the actual times that the vehicle system 102 arrives at or passes by scheduled waypoints and the associated scheduled times.

The differences between when the vehicle system 102 arrives at or passes through one or more scheduled locations and the time that the vehicle system 102 was scheduled to arrive at or pass through the scheduled locations may be used to calculate the statistical measure of adherence to a schedule for the vehicle system 102. In an embodiment, the statistical measure of adherence for the vehicle system 102 may represent the number or percentage of scheduled locations that the vehicle system 102 arrived too early or too late. For example, the monitoring module 332 may count the number of scheduled locations that the vehicle system 102 arrives at or passes through outside of a time buffer around the scheduled time. The time buffer can be one to several minutes. By way of example only, if the time buffer is three minutes, then the monitoring module 332 may examine the differences between the scheduled times and the actual times and count the number of scheduled locations that the vehicle system 102 arrived more than three minutes early or more than three minutes late. Alternatively, the monitoring module 332 may count the number of scheduled locations that the vehicle system 102 arrived early or late without regard to a time buffer.

The monitoring module 332 may calculate the statistical measure of adherence by the vehicle system 102 to the schedule based on the number or percentage of scheduled locations that the vehicle system 102 arrived on time (or within the time buffer). For example, the monitoring module 332 may calculate that the vehicle system 102 adhered to the schedule (e.g., remained on schedule) for 71% of the scheduled locations and that the vehicle system 102 did not adhere (e.g., fell behind or ahead of the schedule) for 29% of the scheduled locations. Additionally or alternatively, the monitoring module 332 may calculate the statistical measure of adherence by the vehicle system 102 to the schedule based on the total or sum of time differences between the scheduled times associated with the scheduled locations and the actual times that the vehicle system 102 arrived at or passed through the scheduled locations.

In an embodiment, the monitoring module 332 may calculate the average statistical measure of adherence by comparing the deviation of each vehicle system 102 from the average or median statistical measure of adherence of the several vehicle systems 102 traveling within the transportation network 100. For example, the monitoring module 332 may calculate an average or median deviation of the measure of adherence for the vehicle systems 102 from the average or median statistical measure of adherence of the vehicle systems 102.

Additionally, the scheduling system 154 may assign the priority to the vehicle system 102 and/or the vehicles within the vehicle system 102 (e.g., the CCV 104, the PGV 108) which may be used by the yard planner system 152 (as described above). The priority may be based on the throughput parameter or statistical measure of adherence determined by the monitoring module 332, a business objective of the transportation network 100 (e.g., delivery deadline of a payload of the CCV 104, reliance on the vehicle system 102 and/or PGV 108 by a plurality of other vehicle systems 102), by the operator of the vehicle yard 200, the central dispatch or other office that generates the trip plans for one or more vehicle systems 102, or the like.

Figure 4:
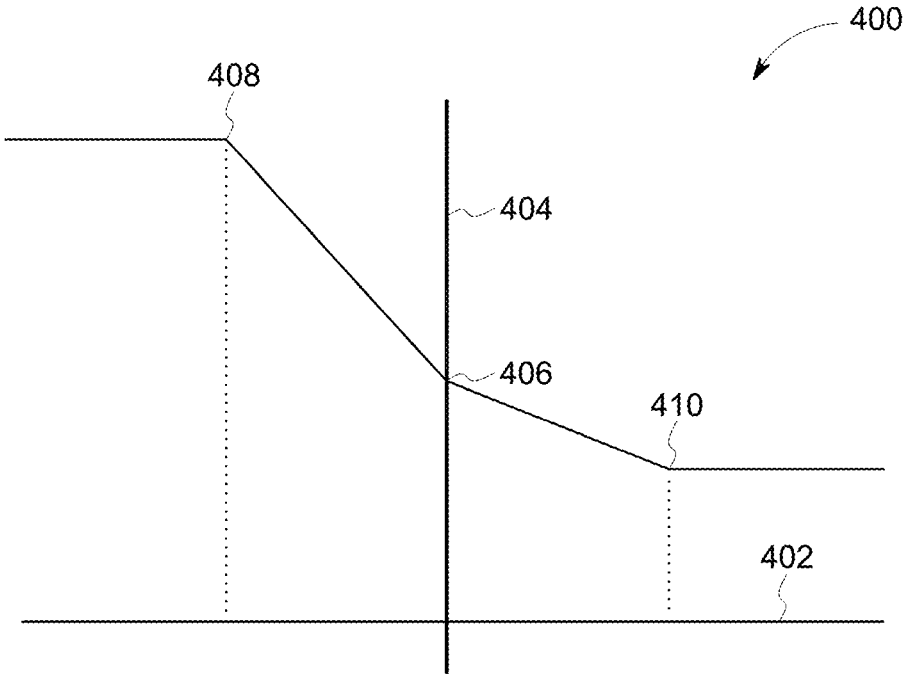
FIG. 4 is an illustration of a priority curve used by an embodiment of a scheduling system.
Figure 5:
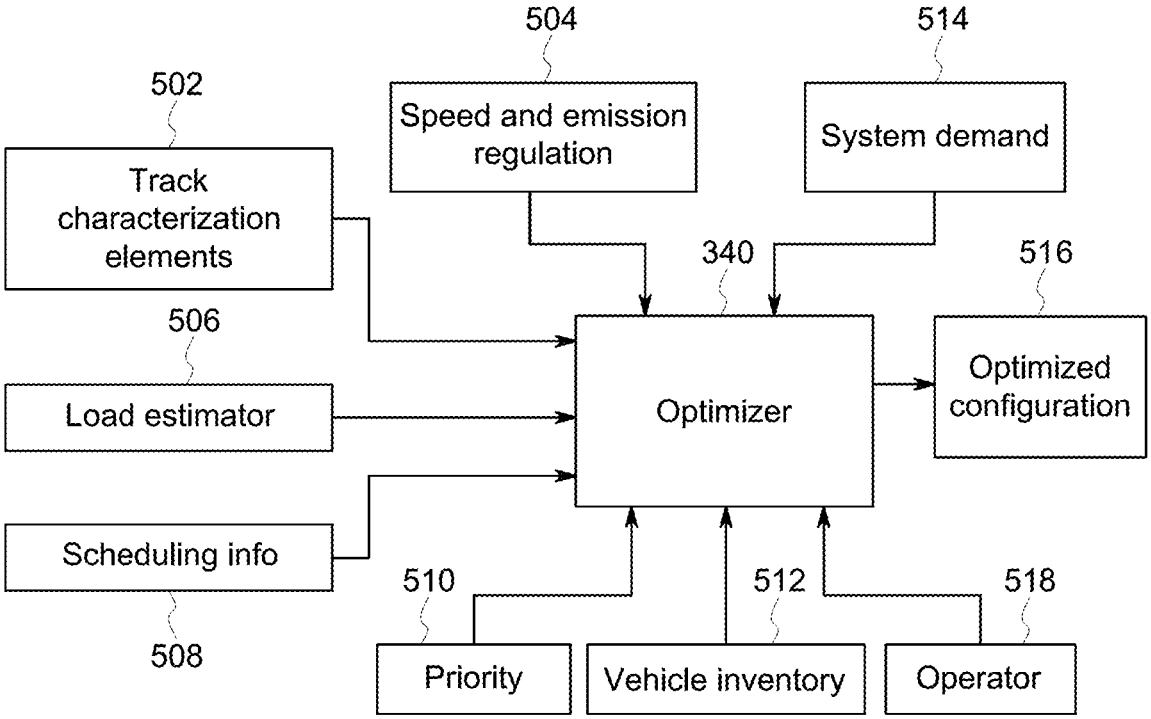
FIG. 5 is an illustration of information used by an optimizer of an energy management system in accordance with an embodiment.

FIG. 4 illustrates a priority curve 400 that may be used by the scheduling system 154. The priority curve 400 may be predetermined and stored on memory 334, received by the scheduling system 154 from an input by the operator using the user interface 306, or the like. The x-axis 402 may represent the statistical measure of adherence. For example, a position traversing left along the x-axis 402 exemplifies a decreasing statistical measure of adherence (e.g., ETA of the vehicle system 102 is greater than or later in time than the scheduled time of arrival), and conversely the position traversing right along the x-axis 402 exemplifies an increasing statistical measure of adherence (e.g., ETA of the vehicle system 102 is lesser than or earlier in time than the scheduled time of arrival). The y-axis 404 represents the priority, such that, a position traversing upwards and away from the x-axis 402 exemplifies an increasing priority and conversely the position traversing towards the x-axis exemplifies a decreasing priority. For example, the monitoring module 332 is tracking three vehicles systems 102A, 102B and 102C entering the vehicle yard 200 (FIG. 2) each having a movement plan. The monitoring module 332 determines a statistical measure of adherence for each vehicle system with respect to the priority curve 400, such that, 406 represents the vehicle system 102A, 408 represents the vehicle system 102B, and 410 represents the vehicle system 102C. Further, using the priority curve 400 the monitoring module 332 may determine a priority (e.g., value of the y-axis) associated for each vehicle system 102A, 102B, 102C and may output the said priorities to the yard planner system 152, using the communication system 302. The priority may be represented as a number for each vehicle system 102, a list of the vehicle systems 102 within the transportation network 100 and/or in the vehicle yard 200 in a priority order, a color scheme, or the like. The yard planner system 152 may determine or adjust the yard plan based on the priority of the incoming vehicle systems 102A, 102B, and 102C and/or vehicle systems 102 currently within the vehicle yard 200. For example, the yard planner system 152 may complete the vehicle connection plan of the vehicle system 102B, represented as 408 on the priority curve 400, before the vehicle connection plans of the vehicle systems 102A and 102C, respectively, due to the higher priority of the vehicle system 102B.

The energy management system 156 may be embodied in hardware, such as a processor, controller, or other logic-based device, that performs functions or operations based on one or more sets of instructions (e.g., software). The instructions on which the hardware operates may be stored on a tangible and non-transitory (e.g., not a transient signal) computer readable storage medium, such as a memory 344. The memory 344 may include one or more computer hard drives, flash drives, RAM, ROM, EEPROM, or the like. Alternatively, one or more of the sets of instructions that direct operations of the hardware may be hard-wired into the logic of the hardware.

The energy management system 156 determines an optimized vehicle system configuration for the movement plan which may be used by the yard planner system 152 to determine a vehicle connection plan to create the yard plan and/or to adjust an existing yard plan. As used herein, the term "optimize" (and forms thereof) are not intended to require maximizing or minimizing a characteristic, parameter, or other object in all embodiments described herein. Instead, "optimize" and its forms are intended to mean that a characteristic, parameter, or other object is increased or decreased toward a designated or desired amount. For example, an "optimized" vehicle system configuration for fuel efficiency is not limited to a complete absence of fuel consumption or that the absolute minimum amount of fuel is consumed by the vehicle system. Rather, the optimized vehicle system configuration for fuel efficiency may mean that the fuel efficiency is increased, but not necessarily maximized, relative to other possible vehicle system configurations available. However, the "optimized" vehicle system configuration for fuel efficiency can include reducing fuel consumption to the minimum amount possible.

As another example, optimized vehicle system configuration for emission generation may not mean completely eliminating the generation of all emissions from the vehicle system. Instead, optimized vehicle system configuration for emission generation may mean that the amount of emissions generated by the vehicle system is reduced but not necessarily eliminated relative to other possible vehicle system configurations available. However, optimized vehicle system configuration for emission generation can include reducing the amount of emissions generated to a minimum amount possible. In an embodiment, the "optimized" vehicle system configuration for a characteristic (e.g., fuel efficiency, generated emissions, weight distribution), parameter (e.g., tractive effort), or other object includes increasing or decreasing the characteristic, parameter, or object (as appropriate) during performance of a mission (e.g., a trip) such that the characteristic, parameters, or object is increased or decreased (as appropriate) relative to performing the same mission in another vehicle system configuration. For example, the energy management system 156 determined that the PGV 108A selected for the vehicle system 102A traveling along a trip according to an optimized vehicle system configuration and trip plan and may result in the vehicle system 102A consuming less fuel and/or generating fewer emissions relative to traveling along the same trip having another vehicle configuration, such as having PGV 108B rather than PGV 108A for the vehicle system 102A.

The optimized vehicle configuration, for example, may be determined by an optimizer module 340 analyzing or calculating different timing and load demands of the vehicle system 102 and the transportation network 100 using different input information. The optimizer module 340 may analyze the movement plan of the vehicle system 102, specifically, the scheduling information 508 (e.g., timing requirements of the vehicle system 102 to arrive at the destination or intermediate location), speed and emission regulations 504 (e.g., predetermined and based on the route 106 location), track characterization elements 502, the vehicle inventory 512, and the load estimator 506 to determine a minimum tractive effort threshold required to be produce by the one or more PGV 108 selected for the optimized vehicle configuration 516 for the vehicle system 102. The optimizer module 340 further selects the one or more PGV 108 based on a sum of the tractive effort produced from each of the PGV 108 of the vehicle inventory 512 is at least or greater than the minimum tractive effort threshold of the vehicle system 102 to arrive within a predetermined time period (e.g., scheduling information 508), and an optimization requirement (e.g., fuel consumption, emission generation) received from the operator 518, the dispatch facility, or the like. Optionally, the optimizer module 340 may additionally base the selection and/or optimized vehicle configuration of the vehicle system 102 on the weight distribution of the vehicle system 102.

The tractive effort is representative of the tractive effort the one or more PGV 108 units are capable of and/or need to provide to propel the vehicle system 102 along the route 106 and 116. The tractive effort may be a measure of pounds force or traction amps (for electric motors). The tractive effort may vary along the movement plan due to changes in parameters, for example, changes in a curvature and/or grade of the route 106, speed limits and/or requirements of the vehicle system 102, or the like. As these parameters change during the movement plan, the total tractive effort, or force, that is required to propel the vehicle system 102 along the track 106 may also change.

The track characterization elements 502 may provide information, for example terrain characteristics, about the remaining segments or portions of the route 106 to be traveled by the vehicle system 102 from the vehicle yard 200 to the destination location and/or remaining intermediate locations before the destination location (e.g., other vehicle yards 200) while following the movement plan. The track characterization elements 502 may be used by the optimizer module 340 to account for additional or reduced tractive effort needed by the one or more PGV 108 until the destination or intermediate location. For example, the vehicle system 102 following the movement plan along the route 106 that has a negative average track grade from the vehicle yard 200 to the destination or intermediate locations. The negative average track grade of the movement plan may require a lower minimum tractive effort threshold of the vehicle system 102 than a positive or zero average track grade, respectively. The track characterization elements 502 may include grade, elevation, curvature information, or the like of the remaining segments of the route 106.

The vehicle inventory may be received by the optimizer module 340 from the yard planner system 152 using the communication system 302 and/or stored on the memory 344. The vehicle inventory 512 may include a database of all available PGV 108 within the vehicle yard 200. The availability of the PGV 108 may be based on the vehicle connection plans of the yard plan (e.g., the available PGV 108 are not included in any vehicle connection plans), the maintenance cycles of the PGV 108, user input by the operator (e.g., through the user interface 306), or the like.

Additionally or alternative, the yard plan may isolate or store the one or more available PGV 108 into a larger group of PGV 120 within the vehicle yard 200. The database may include characteristics of the available PGV 108 such as the weight, propulsion capabilities or tractive effort, fuel efficiency with respect to various speed or tractive efforts, range capabilities on a single fueling, or the like. The vehicle inventory 512 may also include or identify the CCV 104 that are to be included into the optimized vehicle system configuration from the movement plan and/or yard plan (e.g., vehicle connection plans). Optionally, the vehicle inventory 512 may include PGV 108 and/or CCV 104 that are included in vehicle systems 102 that are inbound (e.g., next stop is the vehicle yard 200) within a set distance of the vehicle yard 200 or scheduled to arrive into the vehicle yard 200 within a predetermined future time period (e.g., within thirty minutes of the scheduled departure time of the vehicle system being optimized).

The load estimator 506 calculates a load of the vehicle system 102 based on information contained in the vehicle inventory or yard plan (e.g., the CCV 104 to be included in the vehicle system 102), historical data, a rule of thumb estimation, and/or table data.

In an embodiment, the optimizer module 340 may receive the priority of the vehicle system 102 and/or the CCV 104 from the scheduling system 154 through the communication system 302, vehicle yard operator, dispatch facility, or the like and adjust the minimum tractive effort threshold. For example only, the optimizer module 340 has determined the minimum tractive effort threshold for the vehicle system 102B, not accounting for the priority of the vehicle system 102B, is 40,000 Newtons (N). The vehicle inventory 512 includes the PGV 108B (currently coupled to the vehicle system 102B) and the larger group PGV 120 having the PGV 108A and PGV 108C. The tractive effort of the PGV 108B is 30,000 N which is below the minimum tractive effort threshold for the vehicle system 102B when leaving the vehicle yard 200. The tractive effort of the PGV 108A is 44,000 N and the tractive effort of the PGV 108C is 51,000 N which are both greater than the minimum tractive effort threshold. However, regarding fuel consumption and/or generation of emissions traveling along the movement plan, the PGV 108A is determined by the optimizer module 340 to consume less fuel and/or generates less emissions, respectively, than the PGV 108B. Due to the lower fuel consumption and/or less emissions the optimizer module 340 selects the PGV 108A, and outputs the PGV selection to the yard planner 152 as the vehicle connection plan for vehicle system 102B.

Conversely, continuing with the above example, the inclusion of the priority of the vehicle system 102B may affect the selection of the one or more PGV 108 by the optimizer module 340. The vehicle system 102B may be represented at 408 on the priority curve 400 (FIG. 4) illustrating a high priority. The high priority of the vehicle system 102B may require the vehicle system 102B to demand more power or tractive effort of the one or more PGV 108 (e.g., quick acceleration, higher speed) beyond the preset requirements described above (e.g., track characterization elements, load estimator). Accordingly, the optimizer module 340 may determine that the minimum tractive effort threshold of the vehicle system 102B should be increased to 50,000 N. Due to the high priority of the vehicle system 102B, the optimizer module 340 selects the PGV 108C having a tractive effort of 50,000 N even though the PGV 108A has a higher fuel efficiency, respectively.

In an embodiment, the optimizer module 340 may adjust the selection of the one or more PGV 108 based on the availability of vehicles at the destination or intermediate locations based on a system demand database 514. The system demand database 514 may log requests or status alerts from remote vehicle yards, operators, dispatch facilities, the schedule system 154, or the like of a shortage or need for one or more PVG 108 having certain characteristics (e.g., tractive effort, speed, generated emissions, fuel efficiency). The requests on the system demand database 514 may be automated by the scheduling system 154 to maintain an equal distribution of one or more PGV 108 having a higher tractive effort, set fuel efficiency, emissions, or the like. Optionally, the requests may represent a future or current need by the remote vehicle yard 200 for a PGV 108 having a tractive effort for an awaiting vehicle system 102 within the remote vehicle yard 200.

For example only, the optimizer module 340 has determined the minimum tractive effort threshold for the vehicle system 102A is 35,000 N. The vehicle inventory 512 includes the PGV 108B coupled to an incoming vehicle system (the vehicle system 102B) and the larger group PGV 120 having the PGV 108A and PGV 108C. The tractive efforts are of the PGV 108B is 30,000 N, of the PGV 108A is 44,000 N, and of the PGV 108C is 51,000 N. The optimizer module 340 may compare the movement plan of the vehicle system 102A with the system demand database 514 and determine that one of the intermediate locations (e.g., vehicle yards 200) has a request listed within the system demand database 514 for a PVG 108 having a tractive effort of over 40,000 N. The optimizer module 340 may reset or adjust the minimum tractive effort threshold to match the requested tractive effort of the remote vehicle yard 200 of 40,000 N resulting in the selection of PGV 108A and/or PGV 108C.

Figure 6:
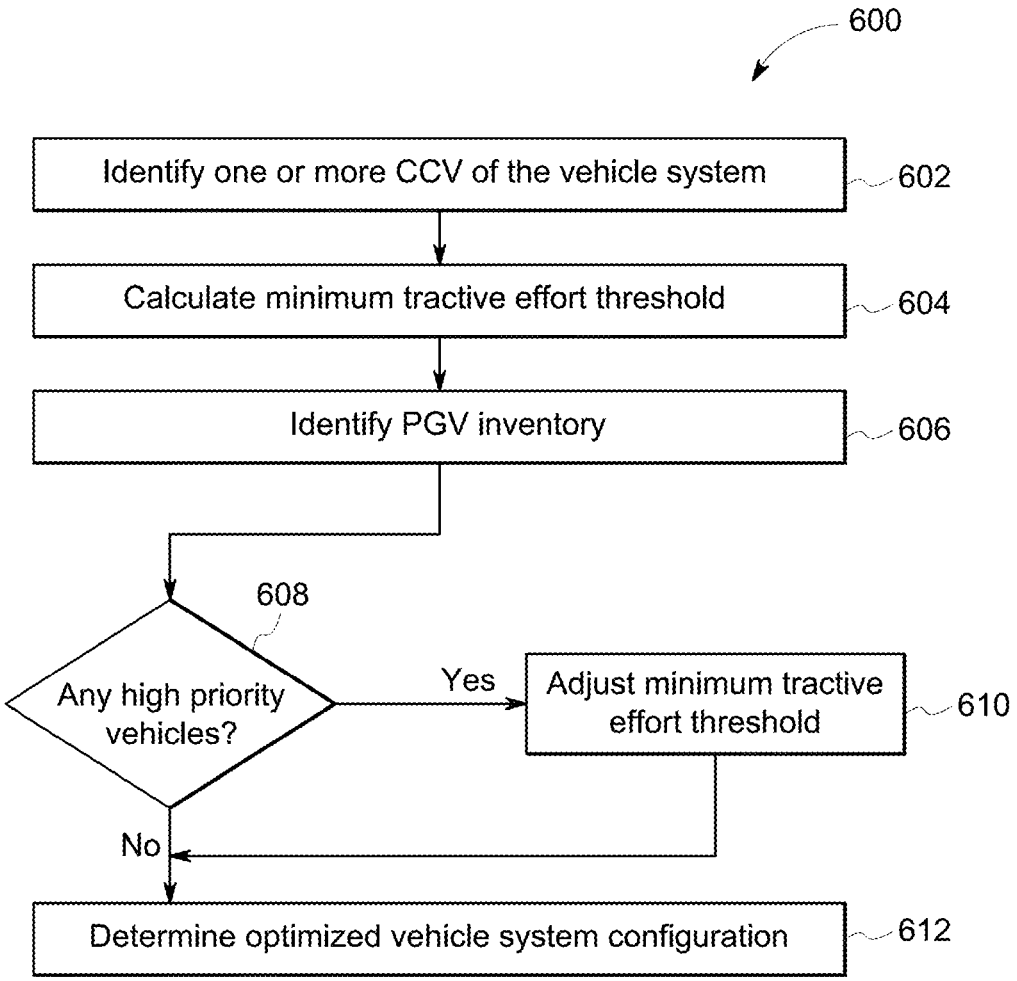
FIG. 6 is a flowchart of an embodiment of a method for a control system of a vehicle yard within a transportation network.

FIG. 6 is a flowchart of a method 600 for a control system 150 for the vehicle yard 200 within a transportation network 100. The method 600 for example, may employ or be performed by structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. In various embodiments, portions, aspects, and/or variations of the method 600 may be able to be used as one or more algorithms to direct hardware to perform one or more operations described herein. Additionally or alternatively, the method 600 may represent a work flow for the operator of a vehicle yard 200.

At 602, identify the one or more CCV 104 for the vehicle system 102. For example, the one or more CCV 104 may be identified by the scheduling system 154 based on the predetermined departure time of the CCV 104, the destination location or intermediate location of the CCV 104, the type of payload within the CCV 104, selection by the operator of the vehicle yard 200, priority of the CCV 104, communication by a remote vehicle yard, or the like. Additionally or alternatively, the yard planner system 152 may identify the one or more CCV 104 using the monitoring system 322 and group the CCV 104 into a CCV group 110 to await coupling with the matched outgoing vehicle system and/or one or more PGV 108 to form the matched outgoing vehicle system.

At 604, calculate the minimum tractive effort threshold. As described above, the energy management system 156 may determine the minimum tractive effort threshold by analyzing the movement plan of the vehicle system 102, specifically, the scheduling information 508 (e.g., timing requirements of the vehicle system 102 to arrive at the destination or intermediate location), speed and emission regulations 504 (e.g., predetermined and based on the route 106 location), track characterization elements 502, the vehicle inventory 512, and the load estimator 506 to determine a minimum tractive effort threshold required to be produce by the one or more PGV 108 selected for the optimized vehicle configuration for the vehicle system 102.

At 606, identify the PGV inventory. As described above, the PGV inventory may be included within the vehicle inventory database 512 received by the optimizer module 340. The PGV inventory may include all available PGV 108 within the vehicle yard 200 based on the vehicle connection plans of the yard plan (e.g., the available PGV 108 are not included in any vehicle connection plans), the maintenance cycles of the PGV 108, user input by the operator (e.g., through the user interface 306), or the like. Additionally, the optimizer module 340 may include PGV 108 within the vehicle inventory database 512 that are included in vehicle systems 102 that are inbound within a set distance of the vehicle yard 200 or scheduled to arrive into the vehicle yard 200 within a predetermined future time period (e.g., within thirty minutes of the scheduled departure time of the vehicle system being optimized).

At 608, determine whether there are any high priority vehicles. If there are high priority vehicles, at 610, adjust the minimum tractive effort threshold. As described above, the priority of the vehicles (e.g., vehicle system 102, CCV 104, PGV 108) may be determined using the priority curve 400 (FIG. 4) by the scheduling system 154, the operator, or the like. Based on the priority of the vehicle, as described above, the optimizer module 340 may adjust the minimum tractive effort threshold, for example, the optimizer module 340 may increase the minimum tractive effort threshold of a high priority vehicle system 102 relative to a low priority vehicle system 102 due to the priority of the vehicle system 102.

At 612, determine an optimized vehicle system configuration. As described above, the optimizer module 340 within the energy management system 156 determines the optimized vehicle configuration by isolating the one or more PGV 108 within the larger group of PGV available within the vehicle inventory database 512 having a tractive effort greater than the minimum tractive effort threshold. Additionally, depending on what is being optimized (e.g., fuel efficiency, emission generation), the optimizer module 340 determines which set of the one or more PGV 108 to be included within the vehicle system 102 having the highest fuel efficiency and/or lowest emission generation relative to the larger group of PGV available within the vehicle inventory database 512.

Optionally, the method 600 may further include automatically generating one or more signals to be communicated to an operator in the vehicle yard 200 to direct coupling of the set of one or more PGV 108 with the CCV 104 to form the vehicle system 102.

Optionally, the method 600 may further include determining a priority of the vehicle system 102 within a rail network 100. The priority of the vehicle system 102 adjusts the minimum tractive effort threshold.

Optionally, the method 600 may additionally base the minimum tractive effort threshold on a terrain of the route 106.

Optionally, the method 600 may further have the selection of the set of one or more PGV 108 further based on a planned position of the set of one or more PGV 108 within the vehicle system 102. Alternatively, the selection of the set of one or more PGV 108 is further based on a weight distribution of the vehicle system. Alternatively, the selection of the set of one or more PGV 108 is further based on a number of available PGV 108 from a remote vehicle yard along the route 106 or a communication from the remote vehicle yard along the route 106.

Optionally, the method 600 may further have the larger group of PGV include PGV 108 entering the vehicle yard 200 within a predetermined future time period. Additionally, the method 600 may further include determining a priority of the CCV 104, such that the priority of the CCV adjusts which PGV 108 are available within the larger group of PGV.

In an embodiment, the memories 324, 334, and/or 344 may contain maintenance data of each PGV 108 within the transportation network 100 and/or vehicle yard 200. The maintenance data may include a maintenance or repair history of the PGV 108 (may include type and date of work completed on the PGV 108), life span or life expectancy of parts installed in the PGV 108 (e.g., bearings, axles, rotors, wheels, lights, air brake valve, or the like), general maintenance schedule of the PGV 108 based on a predetermined distance traveled or a predetermined time of a previous maintenance service (e.g., flushing of fluids, check lubrication), or the like. The maintenance data may be used to determine whether a maintenance cycle of the PGV 108 may be scheduled and included in the yard plan (e.g., vehicle connection plan) to complete a maintenance task (e.g., flushing of fluids, replacing a bearing, or the like) within the vehicle yard 200. For example only, the PGV 108B of the vehicle system 102B enters the vehicle yard 200. The yard planning system 152 may access the general maintenance schedule relating to the PGV 108B stored on the memory 324 determining (e.g., based on a length of time from the last maintenance cycle, based on a distance traveled from the last maintenance cycle) that the maintenance cycle for the PGV 108B may be scheduled and included in the yard plan. Accordingly, the yard planning system 152 may include a vehicle connection plan to partition the PGV 108B from the vehicle system 102B to fulfill the maintenance cycle of the PGV 108B within the vehicle yard 200.

Optionally, the method 600 may have the selection of the set of the one or more PGV 108 further based on the maintenance cycles of the one or more PGV 108. In an embodiment, select vehicle yards 200 within the transportation network 100 may perform maintenance tasks (e.g., replacing bearings within the electric motor) faster than or may have a needed replacement part (e.g., axle) for the maintenance cycle of the PGV 108 relative to other vehicle yards 200 within the transportation network 100. The maintenance task performance (e.g., duration of time to complete the maintenance task) and/or a replacement part inventory of the vehicle yards 200 may be stored within a maintenance database in the memory 344. Additionally, the optimizer module 340 may determine the vehicle configuration of the vehicle system 102 based on the maintenance cycle of the PGV 108.

For example only, a vehicle system 102B that includes the PGV 108B enters the vehicle yard 200A. The PGV 108B, based on the maintenance data, may be determined to need or is due for a maintenance cycle. The maintenance cycle for the PGV 108B may be added to the scheduling information 508. The optimizer module 340, analyzing the scheduling information 508, may determine an idle time based on the maintenance database (e.g., maintenance task performance, replacement inventory) for the vehicle yard 200A and other vehicle yards 200 (e.g., the vehicle yard 200B) within the transportation network 100. The idle time may represent the amount or duration of time the PGV 108B may be unavailable (e.g., not included within the vehicle inventory 512) due to the completion of the maintenance cycle. It should be noted, the idle time may also include an amount of time for the vehicle yard 200 to order or receive a needed replacement part for the maintenance cycle into the replacement part inventory. The optimizer module 340 may compare the idle times for the maintenance cycles performed at various vehicle yards 200, respectively, against a predetermined idle threshold. Once the idle times are determined, the optimizer module 340 may determine the selection of the set of one or more PGV 108 for the various vehicle systems 102 in order to minimize the PGV 108 idle times within the transportation network 100. For example, the optimizer module 340 may determine that the idle time, based on the maintenance cycle, for the vehicle yard 200A may be greater than the predetermined idle threshold. Further, the optimizer module 340 may determine that the idle time, based on the maintenance cycle, within the vehicle yard 200B may be below the predetermined idle threshold. Based on the idle times of the vehicle yards 200, the optimizer module 340 may adjust the selection of the set of one or more PGV 108 based on the destination or intermediate location of the vehicle system 102. For example, the optimizer module 340 may include and/or flag (e.g., prioritize over alternative PGV 108 meeting optimization requirements) the PGV 108B within the vehicle inventory 512 for vehicle systems 102 that have the vehicle yard 200B as a destination or intermediate location within the scheduling information 508.

Conversely, continuing with the example above, the optimizer module 340 may determine that the PGV 108B has an idle time below the predetermined idle threshold for the vehicle yard 200A. Since the idle time is below the predetermined threshold, the optimizer module 340 may instruct the yard planner system 152 to remove the PGV 108B from the available vehicle inventory 512 and include a vehicle connection plan in the yard plan to partition or decouple the PGV 108B from the vehicle system 102B for the maintenance cycle.

In an embodiment, the control system 150 includes the yard planner system 152 having one or more processors. The yard planner system 152 may be configured to create the yard plan for the vehicle yard 200 that includes a vehicle connection plans for coupling a selection of one or more propulsion generating vehicles (PGV) 108 with a selection of one or more cargo-carrying vehicles (CCV) 104 to form a first vehicle system. The yard plan is further created based on the movement plan and an optimized vehicle system configuration of the first vehicle system. The control system 150 also includes the schedule system 154 having one or more processors. The schedule system 154 is configured to create the movement plan of the first vehicle system. The movement plan includes a destination location and predetermined arrival time of the first vehicle system along a route. The control system 150 further includes the energy management system 156 having one or more processors. The energy management system is configured to determine the optimized vehicle system configuration. The optimized vehicle system configuration includes the selection of the one or more PGV 108 from a vehicle inventory having a larger group of PGV (e.g., the larger PGV group 120), based on the movement plan of the first vehicle system and a tractive effort of the selection of the one or more PGV 108.

Optionally, the selection of the one or more PGV 108, by the control system 150, may be further based on fuel consumption and/or emission generation such that the selected one or more PGV 108 have a lower fuel consumption and/or generate less emission than the remaining PGV (e.g., the larger PGV group 120) in the vehicle inventory. It should be noted that the selected one or more PGV 108 has a lower fuel consumption and/or generates less emission with respect to having or respectively to the fuel consumption and/or emissions generated if the one or more of the remaining PGV forming and propelling the vehicle system 102 to the subsequent intermediate location or final destination along the same movement plan.

Optionally, the selection of the one or more PGV 108, by the control system 150, may be further based on the weight distribution of the first vehicle system.

Optionally, the energy management system 156 may be configured to determine the minimum tractive effort threshold required to propel the first vehicle system along the route at or within the predetermined arrival time, and the tractive effort of the selected one or more PGV is at least or greater than the minimum tractive effort threshold. Additionally, the minimum tractive effort threshold may be further based on the terrain of the route.

Optionally, the vehicle inventory may include PGV entering the vehicle yard 200 within a predetermined future time period.

Optionally, the vehicle inventory may be adjusted based on a number of available PGV from a remote vehicle yard 200 along the route or a communication from the remote vehicle yard.

Optionally, the schedule system 154 of the control system 150 may be further configured to assign a priority of the first vehicle system based on the statistical measure of adherence. The statistical measure of adherence may be determined from a position of the first vehicle system relative to a scheduled position of the first vehicle system determined by the movement plan. Additionally, the yard planner system 152 may be configured to adjust the yard plan based on the priority of the first vehicle system, such that, the vehicle connection plan of the first vehicle system displaces a vehicle connection plan of a second vehicle system having a different priority, relatively. Additionally or alternatively, the vehicle inventory may be adjusted based on the priority of the first vehicle system.

Optionally, the yard planner system 152 may generate one or more signals communicating the yard plan to an operator in the vehicle yard 200 to direct coupling of the selection of the one or more PGV 108 with the selection of the one or more CCV 104 to form the first vehicle system.

One embodiment of the subject matter described herein provides a building system and method that optimizes the build of a multi-vehicle system. This system and method can provide insight about different ways to assemble a set of vehicles into a multi-vehicle system. The system and method can examine a departure list or schedule, and available propulsion-generating vehicles as input, and then recommend one or more detailed build orders for the multi-vehicle system to increase fuel efficiency, improve vehicle safety, and/or reduce the build time for the multi-vehicle system given the current locations of the vehicles to be included in the vehicle system. The fuel efficiency can be increased, the safety can be improved, and/or the build time can be reduced relative to one or more other potential builds of the multi-vehicle systems.

The system and method can receive desired contents of a multi-vehicle system and objective weights as inputs. The desired contents can include the propulsion-generating vehicle(s) and/or the non-propulsion-generating vehicle(s) to be included in the multi-vehicle system. The potential vehicles to be included in the multi-vehicle system can be determined from an inventory of the vehicle yard, such as a current list of which vehicles are in the vehicle system and/or a forecasted list of which vehicles are scheduled to be in the vehicle system at a designated or selected time in the future. The objective weights can be system- and/or user-adjustable priorities that can be assigned to or allocated among different objectives or goals of the multi-vehicle system build.

The system or an operator of the system can place greater weight (or priority) on a build time objective, a fuel efficiency objective, and/or a safety objective. For example, different builds may be recommended or identified by the system depending on whether the build time has the greatest weight or priority, whether safety (e.g., reducing inter-vehicle forces, reducing the number of throttle setting changes, reducing the number of times that brakes are applied, etc.) has the greatest weight or priority, or whether fuel efficiency has the greatest weight or priority. The system can output a detailed vehicle list that indicates which vehicles to include in the vehicle system and the order in which the vehicles are to be arranged within the vehicle system. Optionally, the system can generate and communicate control signals to equipment within the vehicle yard that automatically controls the equipment to build the vehicle system according to a build that is selected or recommended by the system. For example, control signals can be communicated to cause cranes to automatically place vehicles in the order of the selected build, to cause propulsion-generating vehicles to automatically move to a location in the selected build, or the like.

Several potential builds of the multi-vehicle system can be determined by the build system by solving an optimization problem with several objectives (e.g., build time, fuel efficiency, and/or safety) that are combined via a weighted sum. The build times can be estimated based on the times needed to build the potential builds, as determined from the yard planner system 152 (described above), in one embodiment. The fuel efficiencies can be estimated based on trip plans (and associated calculated amounts of fuel that are estimated to be consumed during the trip plans), as determined from the energy management system 156 (described above), in one embodiment. The safety of the different builds can be determined from inter-vehicle forces (e.g., forces exerted on one or more vehicles in the multi-vehicle system by other vehicles in the same multi-vehicle system), the number of times that a throttle setting is changed, and/or the number of times that a brake is actuated, as determined by simulating movement of the different builds of the multi-vehicle system over the same trip.

The operator interaction with the build system can take one or more forms. In one embodiment, an interactive mode of the build system can allow for the operator to provide two or more different potential builds of the multi-vehicle system. The build system can calculate values for different metrics based on the objectives, such as a calculated fuel consumption (for the fuel efficiency objective), a calculated build time (for the build time objective), and/or a safety metric (for the safety objective). The safety metric can be a numerical value assigned to the build that is based on the inter-vehicle forces, number of throttle setting changes, and/or number of brake applications. Larger values can be assigned to builds having smaller inter-vehicle forces, a reduced number of throttle setting changes, and/or fewer brake applications, and smaller values can be assigned to builds having larger inter-vehicle forces, a greater number of throttle setting changes, and/or more brake applications.

Optionally, the safety metric can represent a probability or likelihood that a potential build of a multi-vehicle system will break apart or separate during an upcoming trip. This probability can be based on the inter-vehicle forces that are calculated or estimated. For example, larger inter-vehicle forces can be associated with greater likelihoods that a potential build of the multi-vehicle system will break apart during the trip, while smaller inter-vehicle forces can be associated with smaller likelihoods that the potential build of the multi-vehicle system will break apart during the trip, These metrics can be presented to an operator, and the operator can select one of the builds for the multi-vehicle system to be formed according to, or the operator can edit one or more of the potential builds. The system can then re-calculate the metrics and present the metrics for the edited build(s) to the operator. The system and operator can continue in a back-and-forth manner until the operator selects a build to be used to form the multi-vehicle system.

In a decision support mode of the build system, the build system can present the operator with a few potential builds and the metrics associated with the different builds. The operator can then select one of the potential builds for the multi-vehicle system to be formed according to. In an automated mode of the build system, the build system can determine and select a build for the vehicle system based on the metrics that are calculated.

In one embodiment, the control system 150 optionally can be referred to a multi-vehicle build system that determines potential builds of a vehicle system 102, as described herein. The energy management system 156 can determine the potential builds for a multi-vehicle system, calculate the metrics for the potential builds, and provide those metrics to an operator to select a build for use in forming the vehicle system (or can automatically select the build for the vehicle system).

Figure 7:
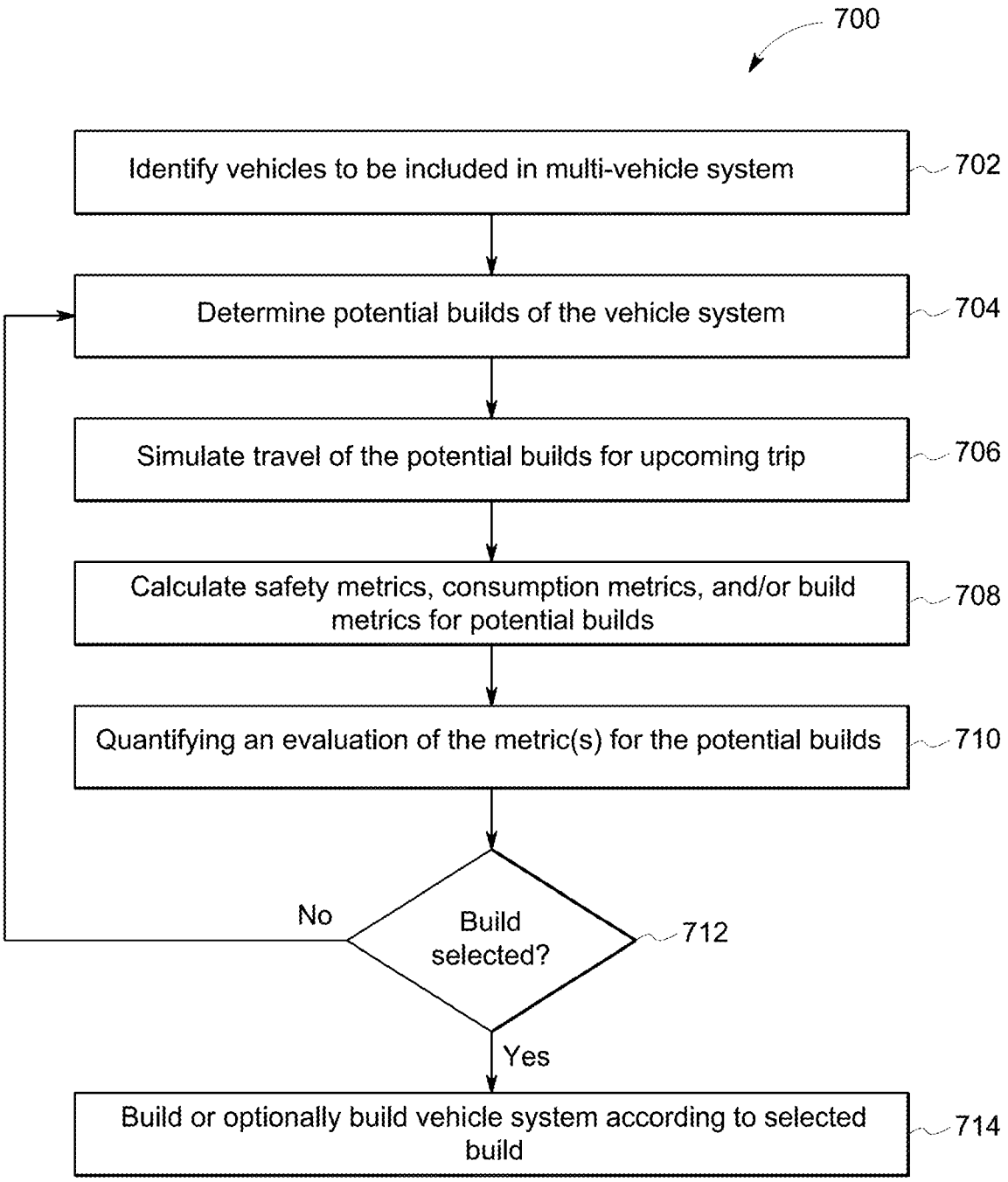
FIG. 7 illustrates a flowchart of one embodiment of a method for building a multi-vehicle system.

FIG. 7 illustrates a flowchart of one embodiment of a method 700 for building a multi-vehicle system. The method 700 can represent operations performed by the energy management system 156. At 702, vehicles that are to be included in the multi-vehicle system 102 are identified. The vehicles 104, 108 are identified for inclusion in the vehicle system for an upcoming trip of the vehicle system, such as a trip from one location to one or more other locations along one or more of the routes 116 shown in FIG. 1. The vehicles 104, 108 can be identified based on a schedule by which one or more of the vehicles 104, 108 (or cargo being carried by the vehicles 104, 108) are to arrive at one or more locations. For example, the energy management system 156 can communicate with the scheduling system 154 to determine scheduled dates and/or times that various non-propulsion-generating vehicles 104 are to depart from a vehicle yard, are to arrive within another vehicle yard, and/or are to arrive at one or more other locations. Optionally, the vehicles 104, 108 can be identified based on which vehicles 104, 108 are within a vehicle yard.

The energy management system 156 can communicate with the yard planner system 152 to determine which vehicles 104, 108 are in the vehicle yard managed by the yard planner system 152. The yard planner system 152 can provide the vehicle inventory 512 to the energy management system 156. As described above, the inventory 512 can indicate which propulsion-generating vehicles 108 are in the vehicle yard, and optionally can indicate which non-propulsion-generating vehicles 104 are in the vehicle yard. The vehicle inventory 512 optionally can include information on when one or more vehicles 104, 108 are scheduled to arrive at the vehicle yard, which can indicate a future or upcoming availability of vehicles 104, 108 in the vehicle yard.

Figure 8:
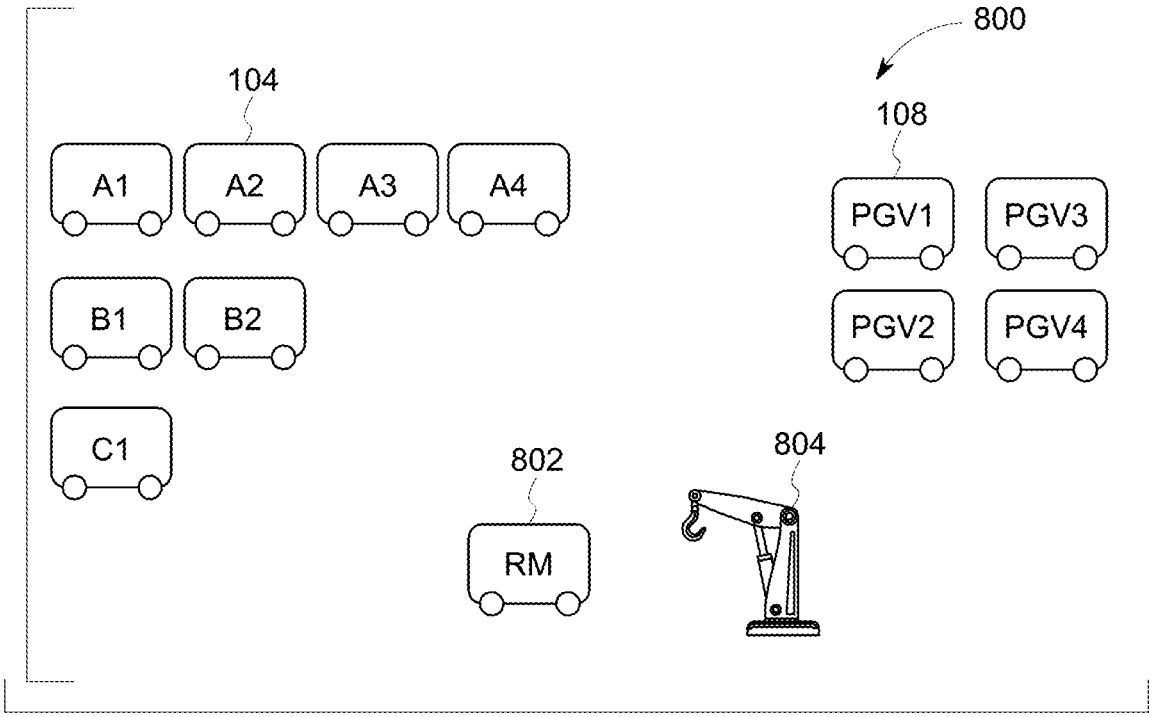
FIG. 8 illustrates one example of an inventory of vehicles and equipment in a vehicle yard.

At 704, potential builds of the multi-vehicle system are determined. The potential builds are different sequential orders in which the vehicles 104, 108 to be included in the vehicle system 102 can be arranged. For example, different builds can have two or more different vehicles 104, 108 adjacent or neighboring each other. FIG. 8 illustrates one example of an inventory 800 of vehicles 104, 108 and equipment 802, 804 in a vehicle yard. As shown, the inventory 800 includes four propulsion-generating vehicles 108 (labeled PGV1, PGV2, PGV3, and PGV4 in FIG. 8) and seven non-propulsion-generating vehicles 104 (labeled A1, A2, A3, A4, B1, B2, and C1 in FIG. 8). Alternatively, the inventory 800 may include more or fewer vehicles 104 and/or vehicles 108. In one embodiment, all the vehicles 104, 108 shown in FIG. 8 are to be included in the vehicle system 102 being built. Alternatively, fewer than all the vehicles 104, 108 shown in FIG. 8 may be included in the vehicle system 102.

Optionally, the inventory 800 can indicate what equipment 802, 804 is in the vehicle yard and is useable for forming the vehicle system 102. The equipment 802 represents a railcar mover, which is a vehicle that operates to move vehicles 104 and/or 108 in the vehicle yard to form the vehicle system 102. The equipment 804 represents a crane or other equipment that also can operate to move cargo, and/or vehicles 104, 108 in the vehicle yard to form the vehicle system 102.

Figure 9:
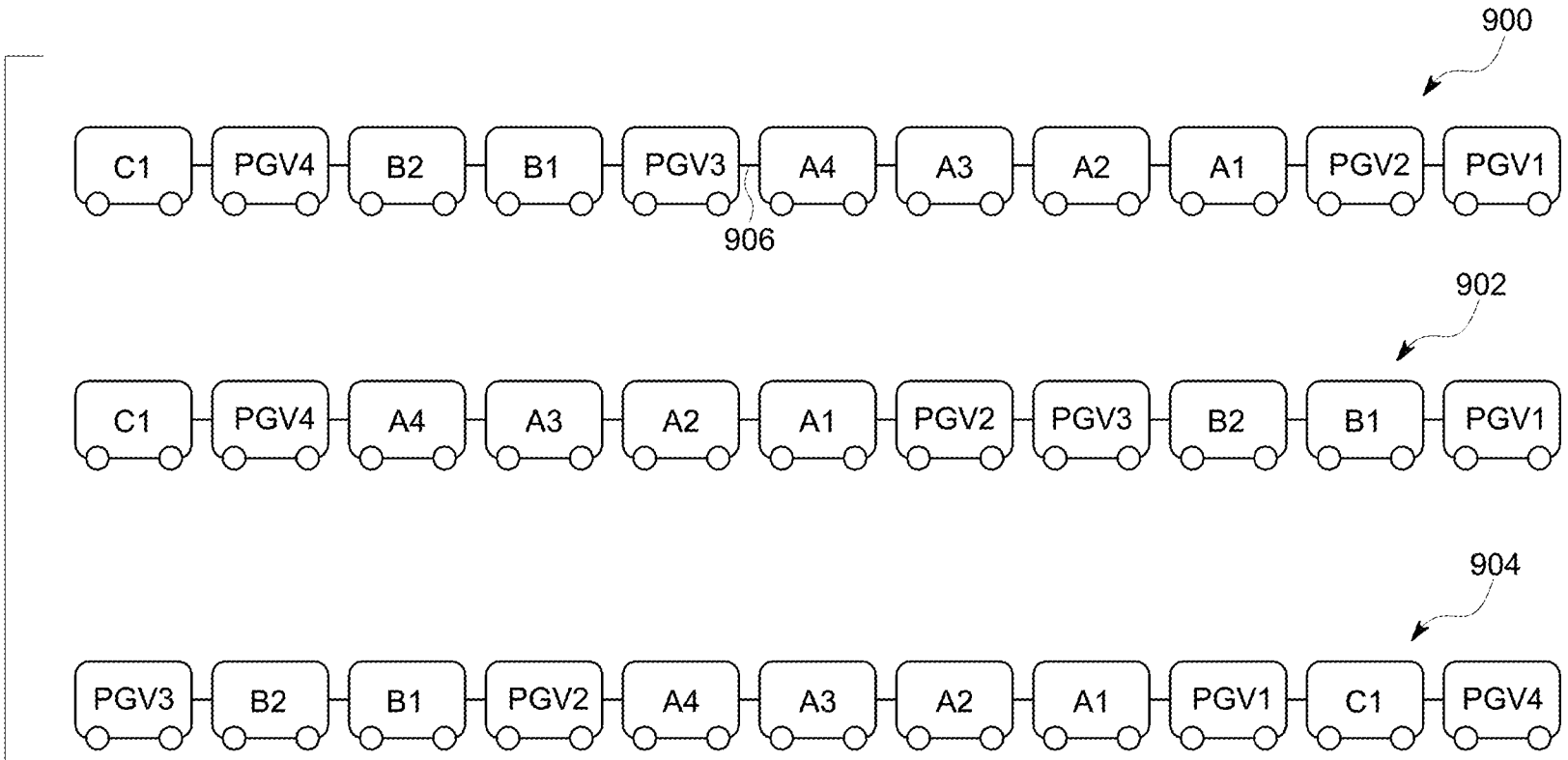
FIG. 9 illustrates examples of different potential builds of the vehicle system shown in FIG. 1.

The energy management system 156 can virtually create the different builds of the vehicle system 102 by determining different arrangements of some or all the vehicles 104, 108. These potential builds are virtual in that the vehicles 104, 108 are not yet moved to the locations dictated by the builds, but the builds are digitally created to analyze the metrics of the builds, as described herein. FIG. 9 illustrates some examples of different potential builds 900, 902, 904 of the vehicle system 102. The build 900 includes the propulsion-generating vehicles PGV1, PGV2 at one end of the vehicle system 102, followed by a block of the non-propulsion-generating vehicles A1, A2, A3, A4, followed by the propulsion-generating vehicle PGV3, followed by the non-propulsion-generating vehicles B1, B2, followed by the propulsion-generating vehicle PGV4, and followed by the non-propulsion-generating vehicle C1. The other builds 902, 904 have different orders in which the vehicles 104, 108 are arranged, as shown in FIG. 9. As shown, two or more of the vehicles 104, 108 can be mechanically coupled with each other by a coupler 906. Alternatively, the vehicles 104, 108 may not be mechanically coupled with each other.

Potential builds of the same vehicle system 102 can differ from each other in a variety of ways. Different potential builds can include different numbers of propulsion-generating vehicles 108. For example, one potential build can include two propulsion-generating vehicles 108, while another potential build includes a single propulsion-generating vehicle 108 or more than two propulsion-generating vehicles 108. Different potential builds can include different locations of the propulsion-generating vehicles 108 in the multi-vehicle system 102. For example, some builds can include the propulsion-generating vehicles 108 toward the front end of the vehicle system 102, while other builds can include the propulsion-generating vehicles 108 toward the back end of the vehicle system 102 or in different distributions throughout the length of the vehicle system 102. Different potential builds of the vehicle system 102 can have different numbers of the non-propulsion-generating vehicles 104 of the vehicles in the multi-vehicle system 102. For example, different potential builds can have fewer or larger numbers of the non-propulsion-generating vehicles 104. Different potential builds can include different locations of the non-propulsion-generating vehicles 104 in the multi-vehicle system 102. For example, some builds can include different ones or groups of the non-propulsion-generating vehicles 108 between different propulsion-generating vehicles 108.

In one embodiment, the energy management system 156 can create the potential builds of the vehicle system 102 using any arrangement of the vehicles 104, 108. Alternatively, the energy management system 156 may be restricted by one or more build rules that limit how the potential builds can be formed. These build rules can require that one or more blocks of non-propulsion-generating vehicles 104 remain together in the different potential builds. A block of non-propulsion-generating vehicles 104 can be a group of the vehicles 104 that is scheduled or otherwise planned to depart from the same location and/or arrive at the same final location. For example, the group of non-propulsion-generating vehicles A1, A2, A3, A4 may be one block of vehicles 104 and the group of non-propulsion-generating vehicles B1, B2 may be another block of vehicles 104. If the energy management system 156 is required to keep the vehicles 104 in each of these blocks together, then the energy management system 156 cannot create a potential build having any vehicle 104 and/or 108 between any of the vehicles A1, A2, A3, A4, and the energy management system 156 cannot create a potential build having any vehicle 104 and/or 108 between the vehicles B1, B2. In one embodiment, the order of the non-propulsion-generating vehicles 108 within each block can be different in the different builds. Alternatively, the order of the non-propulsion-generating vehicles 108 within each block must remain constant in the different potential builds.

Another example of a build rule can be a requirement that all propulsion-generating vehicles 108 in the vehicle system 102 be located at one end (e.g., the front end or the opposite rear end) of the vehicle system 102. Alternatively, such a build rule may not require that all potential builds include all propulsion-generating vehicles 108 at the front end or rear end of the vehicle system 102. Instead, the build rule can require that at least one (but not necessarily all) potential builds include all propulsion-generating vehicles 108 at the front end or opposite rear end of the vehicle system 102.

Another example of a build rule can be a requirement that at least one propulsion-generating vehicle 108 be located adjacent to or neighbor a block of at least a designated number of non-propulsion-generating vehicles 104. For example, such a build rule can require that the potential builds having a block of three or more non-propulsion-generating vehicles 104 also have at least one propulsion-generating vehicle 108 adjacent to the front end or the rear end of the block.

Another example of a build rule can be a requirement that at least one propulsion-generating vehicle 108 be located adjacent to or neighbor a non-propulsion-generating vehicle 104 or a block of the vehicles 104 that weigh at least a designated amount. This rule can require placement of propulsion-generating vehicles 108 next to heavier non-propulsion-generating vehicles 104 or heavier groups of non-propulsion-generating vehicles 104.

Returning to the description of the flowchart of the method 700 shown in FIG. 7, at 706, travel of potential builds of the multi-vehicle system are simulated. This simulated travel can be performed by the energy management system 156. The travel is simulated by tracking digital representations of movements of different potential builds of the vehicle system 102 along the same routes from the same starting location to the same final destination location. Alternatively, the travel can be simulated by tracking digital representations of movements of at least two of the different potential builds of the vehicle system 102 along different routes from the same starting location to the same final destination location. The energy management system 156 can use route information, vehicle information, and/or externality information to simulate the travel of the different builds of the vehicle system 102. The route information can include grades, curvatures, speed limits, or the like, of the routes that the different potential builds of the vehicle system 102 will travel along for the upcoming trip. The vehicle information can include the power that the different propulsion-generating vehicles 108 in the different potential builds of the vehicle system 102 are able to generate to propel the vehicle system 102. The vehicle information also can include the weight of the different vehicles 104, 108 in the different builds. Optionally, the energy management system 156 can simulate the travel of the different builds of the vehicle system 102 using weather conditions, such as wind speed and direction, the presence or absence of precipitation, temperature, etc. The weather conditions can impact the simulated movements of the vehicle system 102 due to different wind drag forces being imparted on the vehicle system 102, different wheel slippage due to precipitation, different outputs by the propulsion-generating vehicles 108 due to extreme hot or cold temperatures, etc. The weather conditions can be forecasted weather conditions or user-provided weather conditions.

The travels of the different builds of the same vehicle system 102 can be simulated by the energy management system 156 using one or more trip plans. A trip plan can designate operational settings of the vehicle system 102 at one or more of different locations, different times during the trip, and/or different distances along routes in the trip. The operational settings can be moving speeds of the vehicle system 102, throttle settings of the propulsion-generating vehicles 108, brake settings of the vehicles 104 and/or 108, or the like. The energy management system 156 can create the trip plan to reduce one or more of fuel consumption, emission generation, wear, inter-vehicle forces, or the like, of the vehicle system 102 (relative to traveling using operational settings other than the operational settings dictated by the trip plan). The trip plan can be created to cause the vehicle system 102 to travel at or within a designated range (e.g., 10% or less) of speed limits of the routes in one embodiment. Optionally, the trip plan can be created to cause the vehicle system 102 to arrive at one or more locations at or within the designated range of scheduled arrival times.

The energy management system 156 can simulate travel of the different potential builds of the vehicle system 102 as the vehicles 104, 108 operate according to the settings dictated by the trip plan (in the simulation(s)). The travels of the different potential builds can be simulated using the exact same trip plan for each simulated trip. Alternatively, travel of two or more of the potential builds can be simulated using different trip plans. For example, a trip plan may not be able to be used to simulate travel of some potential builds due to the trip plan dictating throttle settings of more propulsion-generating vehicles 108 than are present in the potential builds. Therefore, the energy management system 156 may create one or more other trip plans to simulate the travels of these potential builds.

The travel can be simulated so that the energy management system 156 can estimate or calculate metrics of the different potential builds of the vehicle system 102. In one embodiment, safety metrics of the different potential builds are calculated from or based on the simulated travels of the potential builds according to the trip plan. The safety metrics can include inter-vehicle forces that are calculated from the simulated travel. An inter-vehicle force can be the force that is exerted on one vehicle 104, 108 by another vehicle 104, 108, such as the force exerted on one vehicle 104, 108 by a neighboring, mechanically coupled vehicle 104, 108. The inter-vehicle forces can be coupler forces, or forces exerted on a coupler that couples one vehicle 104, 108 with another vehicle 104, 108. Alternatively, the safety metrics can be another measurement of a characteristic of simulated travel of the potential builds of the vehicle system 102 that could lead to damage or failure of the vehicle system 102, such as the vehicle system 102 breaking apart into two or more smaller segments, the vehicle system 102 tipping over, the vehicle system 102 traveling an unsafe speed (e.g., speeds in excess of speed limits of the routes), or the like.

The safety metrics can be calculated as forces expected to be exerted on couplers between the vehicles in the vehicle system 102. These forces can increase when there are propulsion-generating vehicles 108 on opposite sides of a coupler (but not necessarily directly connected with the coupler) and are moving in opposite directions or are moving in the same direction (but with different throttle settings), when the vehicle system 102 travels over a peak in a route, when the vehicle system 102 travels over a valley in the route, when the vehicles connected by the coupler are heavier, when the vehicle system 102 travels on a curved portion of the route, and the like. The forces can decrease when there are propulsion-generating vehicles 108 on only one side of the coupler, when there are propulsion-generating vehicles 108 are on opposite sides of the coupler moving in the same direction and/or moving with the same throttle settings, when the vehicle system 102 travels over a flat portion of the route, when the vehicles connected by the coupler are lighter, when the vehicle system 102 travels on a straight portion of the route, and the like. The information used to calculate or estimate the forces can be obtained from the details of the trip plan or the information used to create the trip plan, such as characteristics of the route and/or different potential builds of the vehicle system 102 that are obtained from the energy management system 156.

In one embodiment, the safety metrics can be calculated or estimated for situations in which the trip plan dictates that the propulsion-generating vehicles 108 in the potential builds of the vehicle system 102 are directed to generate tractive power at an upper designated power limit. For example, the safety metrics can be calculated or estimated at times in the simulated travel when one or more of the propulsion-generating vehicles 108 are operating at a maximum throttle setting. This can result in the value of the safety metric representing a worst-case scenario in the simulation where the inter-vehicle forces are likely (e.g., more likely than not) to be at their largest values during the simulation.

Additionally or alternatively, the safety metrics can be calculated or estimated for situations in which the trip plan dictates that the propulsion-generating vehicles 108 in the potential builds of the vehicle system 102 are directed to generate braking effort at an upper designated braking limit. For example, the safety metrics can be calculated or estimated at times in the simulated travel when one or more of the vehicles 104 and/or 108 are actuating brakes of the vehicles 104 and/or 108 at maximum brake settings (e.g., the brakes fully depressed). This can result in the value of the safety metric representing a worst-case scenario in the simulation where the inter-vehicle forces are likely (e.g., more likely than not) to be at their largest values during the simulation.

In one embodiment, the safety metric for one or more of the potential builds of the vehicle system 102 can have a value that changes based on the presence of certain types of cargo being carried by a vehicle 104 in the vehicle system 102. For example, if a vehicle 104 in a potential build is carrying hazardous cargo, then the value of the safety metric can be adjusted (e.g., decreased) to reflect the dangerous cargo onboard the vehicle 104. Hazardous cargo can include pressurized containers, flammable substances, oxidizing substances, toxic substances, infectious substances, radioactive substances, corrosive substances, and the like.

The travel can be simulated so that the energy management system 156 additionally or alternatively can estimate or calculate consumption metrics of the different potential builds of the vehicle system 102. In one embodiment, consumption metrics of the different potential builds are calculated from or based on the simulated travels of the potential builds according to the trip plan. The consumption metrics can include amounts of fuel and/or electric energy expected to be consumed by the different potential builds of the vehicle system 102 during the upcoming trip. For example, if the propulsion-generating vehicles 108 in the different potential builds operate by consuming fuel, then the consumption metrics can indicate the volume of fuel that is expected to be consumed by the propulsion-generating vehicles 108 in the different builds over the course of the entire upcoming trip. If the propulsion-generating vehicles 108 in the different potential builds are powered by electric current (and not by consuming fuel), then the consumption metrics can indicate the electric power that is expected to be needed to power the propulsion-generating vehicles 108 in the different builds over the course of the entire upcoming trip.

The consumption metrics can increase when the size and/or total weight of a potential build of the vehicle system 102 is greater, when there are more propulsion-generating vehicles 108 in a proposed build, when the routes planned for travel in the trip plan include steeper uphill grades, when the routes planned for travel in the trip plan include sharper curves (e.g., smaller radii of the curves), when the total distance traveled for the trip according to the trip plan increases, when the routes of the upcoming trip have faster speed limits, and the like. The consumption metrics can decrease when the size and/or total weight of a potential build of the vehicle system 102 is smaller, when there are fewer propulsion-generating vehicles 108 in a proposed build, when the routes planned for travel in the trip plan include flatter grades or more downhill grades, when the routes planned for travel in the trip plan are straighter, when the routes of the upcoming trip have slower speed limits, when the total distance traveled for the trip according to the trip plan decreases, and the like. At least some of the information used to calculate the consumption metrics can be obtained from a route database storing grades, curvatures, speed limits, and the like, of the routes of the upcoming trip. Information used to calculate the consumption metrics also can be obtained from the energy management system 156.

In one embodiment, the energy management system 156 can calculate the consumption metrics for potential builds of the vehicle system 102 based on calculated or estimated wind drag forces exerted on the different potential builds of the multi-vehicle system 102 during the travels that are simulated. For example, the energy management system 156 can assume (e.g., use default values) or be provided with wind speed and direction, and can calculate wind drag forces exerted on the different builds of the vehicle system 102 during the simulated travel. The energy management system 156 optionally can obtain weather forecasts or measurements of wind speed and direction, and use this information to calculate or estimate the wind drag forces that are expected to be imparted on the potential builds of the vehicle system 102. Greater wind drag forces can result in the energy management system 156 calculating increased consumption metrics, while lesser wind drag forces can result in the energy management system 156 calculating reduced consumption metrics.

Additionally or alternatively, the energy management system 156 can calculate the consumption metrics for potential builds of the vehicle system 102 based on locations of the propulsion-generating vehicles 108 in the different potential builds of the vehicle system 102. Potential builds having the propulsion-generating vehicles 108 located throughout the vehicle system 102 (e.g., at the front end, middle, and back end of the vehicle system 102) may have lesser consumption metrics than potential builds having more propulsion-generating vehicles 108 toward one end (e.g., the front end or rear end) and/or in the middle of the vehicle system 102.

The travel can be simulated so that the energy management system 156 additionally or alternatively can estimate or calculate build metrics of the different potential builds of the vehicle system 102. In one embodiment, build metrics of the different potential builds represent how long it is expected to take to form the vehicles 104, 108 into the vehicle system 102 in the different potential builds. The build metrics can be based on locations of the vehicles 104, 108 in the vehicle yard, the presence (or absence) of the vehicles 104, 108 in the vehicle yard, the need to add or remove one or more vehicles 104, 108 to or from the vehicle system 102 during the upcoming trip (e.g., the trip plan may dictate that one or more vehicles 104, 108 be added or removed at a vehicle yard located between a beginning and end of the trip), the locations of equipment used to move or place the vehicles 104, 108 in the vehicle yard, the availability of this equipment, and the like. This information can be obtained from the yard planner system 152 and/or the scheduler system 154.

The build metrics can indicate longer build times for potential builds having vehicles 104, 108 that are located in more different locations in the vehicle yard, for potential builds that include vehicles 104, 108 that are not yet in the vehicle yard (but that may be scheduled to arrive at a later time), for trips that involve adding or removing vehicles 104, 108 to or from the vehicle system 102 during the trip, for potential builds requiring the usage of equipment in more different locations in the vehicle yard (to place the vehicles 104, 108 into the order of the potential build), for potential builds requiring equipment that is not yet available, for fewer routes within the yard being available to move vehicles 104, 108 on during building of the vehicle system 102, for more vehicles 104, 108 in the build having scheduled maintenance, and the like. The build metrics can indicate shorter build times for potential builds having vehicles 104, 108 that are located in fewer different locations in the vehicle yard, for potential builds that include vehicles 104, 108 that are already in the vehicle yard, for trips that do not involve adding or removing vehicles 104, 108 to or from the vehicle system 102 during the trip, for potential builds requiring the usage of equipment in fewer different locations in the vehicle yard, for potential builds requiring equipment that is already available, for more routes within the yard being available to move vehicles 104, 108 on during building of the vehicle system 102, for fewer vehicles 104, 108 in the build having scheduled maintenance, and the like. The information needed to calculate or estimate the build metrics can be obtained from the yard planner system.

The metrics that are calculated or estimated from the simulated travel can be normalized. For example, the safety metrics can be calculated as inter-vehicle forces, such as the largest inter-vehicle forces, expected to occur during a trip. The consumption metrics can be calculated as volumes of fuel expected to be consumed by the different potential builds during the trip. The build metrics can be calculated as lengths of time that the potential builds are expected to require to form the vehicle system 102. These metrics can be normalized by assigning a value to each metric based on how close or far the metric is from an upper limit and/or a lower limit associated with that metric.

The safety metric can be normalized by calculating a value between zero and one, between zero and one hundred, or the like, based on how close or far the calculated safety metric is to an upper limit on inter-vehicle forces and/or a lower limit on the inter-vehicle forces. The upper limit can be associated with a specification on couplers that designates forces at which the couplers will or are more likely than not to fail. Larger safety metrics can indicate smaller calculated forces (and, therefore, likely safer travel of the vehicle system 102). For example, a safety metric having a value of 0.7 or 70 can indicate that the safety metric indicates that the inter-vehicle forces in a potential build of the vehicle system 102 are farther from the upper limit on inter-vehicle forces, while a safety metric having a value of 0.3 or 30 can indicate that the safety metric indicates that the inter-vehicle forces in a potential build of the vehicle system 102 are closer to the upper limit on inter-vehicle forces.

Optionally, the safety metric can be normalized by converting the calculated inter-vehicle forces to a probability that one or more couplers in the potential build of the vehicle system 102 will not fail. This probability can be based on one or more of the calculated inter-vehicle forces and a specified limit on how much force a coupler can withstand before failure. The probability of failure can be larger when the largest inter-vehicle force for a potential build is calculated to be farther from this specified limit, and the probability of failure can be smaller when the largest inter-vehicle force for a potential build is calculated to be closer to the specified limit.

The consumption metric can be normalized by calculating a value between zero and one, between zero and one hundred, or the like, based on how much fuel or power is calculated as being consumed by the potential builds relative to each other or relative to designated limits. For example, the potential build having the largest amount of fuel expected to be consumed during the upcoming trip can be assigned a consumption metric with a value of zero (on a scale of zero to one, or on a scale of zero to one hundred), while the potential build having the smallest amount of fuel expected to be consumed during the upcoming trip can be assigned a consumption metric with a value of one (on the scale of zero to one) or one hundred (on the scale of zero to one hundred). As another example, the amounts of fuel or power expected to be consumed by the potential builds can be compared to a static or fixed upper limit. The potential builds having amounts of fuel expected to be consumed during the upcoming trip that are farther from an upper limit may be assigned a larger value (e.g., closer to the value of one on the scale of zero to one, or closer to the value of one hundred on the scale of zero to one hundred). The potential builds having amounts of fuel expected to be consumed during the upcoming trip that are closer to the upper limit may be assigned a smaller value (e.g., closer to the value of zero on the scale of zero to one or on the scale of zero to one hundred).

The build metric can be normalized by calculating a value between zero and one, between zero and one hundred, or the like, based on how long the different potential builds are calculated as taking to form relative to each other or relative to designated limits. For example, the potential build having the shortest build time can be assigned a consumption metric with a value of one (on a scale of zero to one) or one hundred (on a scale of zero to one hundred), while the potential build having the longest build time can be assigned a consumption metric with a value of zero (on the scale of zero to one or on the scale of zero to one hundred). As another example, the build times can be compared to a static or fixed upper limit. The potential builds having build times that are farther from an upper limit may be assigned a larger value (e.g., closer to the value of one on the scale of zero to one, or closer to the value of one hundred on the scale of zero to one hundred). The potential builds having build times that are closer to the upper limit may be assigned a smaller value (e.g., closer to the value of zero on the scale of zero to one or on the scale of zero to one hundred).

At 710, evaluations of the metrics associated with the different potential builds of the vehicle system are quantified. The energy management system 156 can calculated a quantified evaluation of the metrics associated with a potential build by summing the normalized values of the safety metric, the build metric, and/or the consumption metric. As another example, the energy management system 156 can calculated a quantified evaluation of the metrics associated with a potential build by calculating an average of the normalized values of the safety metric, the build metric, and/or the consumption metric. As another example, the energy management system 156 can calculated a quantified evaluation of the metrics associated with a potential build by calculating a median of the normalized values of the safety metric, the build metric, and/or the consumption metric. As another example, the energy management system 156 can calculated a quantified evaluation of the metrics associated with a potential build by identifying the largest (or, alternatively, the smallest) of the normalized values of the safety metric, the build metric, and/or the consumption metric, and using the largest (or smallest) metric as the quantified evaluation for the potential build.

Optionally, the energy management system 156 can calculate the quantified evaluation of the metrics associated with a potential build based on a weighted combination of the metrics. The weighted combination can be calculated by the energy management system 156 applying different weight factors to the metrics of the potential build, and then combining the weighted metrics (e.g., by summing, averaging, or the like, the weighted metrics, as described above). As one example, a weight factor of two can be applied to the safety metric, a weight factor of one can be applied to the consumption metric, and a weight factor of one half can be applied to the build metric. The energy management system 156 can calculate the quantified evaluation of the metrics of the potential builds by multiplying the safety metric for a potential build by two, multiplying the consumption metric of the potential build by one, multiplying the build metric of the potential build by one half, and then summing these weighted metrics to obtain a single value of the quantified evaluation for the potential build. The quantified evaluations also can be calculated for the other potential builds to provide values that can be compared against each other to select a potential build.

The operator may choose to change the value of one or more of the weight factors depending on the relative importance of the metrics. For example, if the operator considers safe travel of the vehicle system 102 to be more important than the build time or amount of fuel consumed, then the operator can increase the value of the weight applied to the safety metric and optionally reduce the values of the weights applied to the consumption and build metrics.

Alternatively, the quantified evaluations for the potential builds can be the metrics that are calculated for each of the potential builds. For example, the energy management system 156 may not change or combine the metrics for a build, but can present one or more, or all, of the metrics associated with the potential builds being considered to the operator of the control system 150 as the quantified evaluations.

At 712, a determination is made as to whether a potential build is selected for forming the vehicle system. In one mode of operation of the control system 150, the energy management system 156 can direct the user interface 306 (e.g., a display device) to present the quantified evaluations of the potential builds. This mode of operation can be referred to as a decision support mode. The energy management system 156 can direct the user interface 306 to present a limited number of potential builds, such as the potential builds associated with the top 10% of values of quantified evaluations. The operator can then select one of the potential builds to be used to form the vehicle system 102 using the user interface 306, such as by using an input device (e.g., a touchscreen, electronic mouse, stylus, keyboard, or the like, of the interface 306) to select a potential build.

In another mode of operation of the control system 150, the energy management system 156 can automatically select a potential build from among many evaluated potential builds for forming the vehicle system 102. This mode of operation can be referred to as an automated mode of operation. The energy management system 156 can compare the quantified evaluations of the potential builds and select the potential build having the largest value of the quantified evaluations for use in forming the vehicle system 102. Alternatively, the energy management system 156 can compare one of the metrics (e.g., the safety metric) of the potential builds and select the potential build having the largest value of the metric for use in forming the vehicle system 102. The energy management system 156 may filter out or remove some potential builds from consideration in forming the vehicle system 102. For example, the energy management system 156 may discard, disregard, or otherwise remove from consideration those potential builds having safety metrics that are below a designated threshold, which can indicate potential builds that are more likely to result in the vehicle system 102 breaking apart during travel.

In another mode of operation of the control system 150, the energy management system 156 can interact with the operator of the control system 150 to select a potential build for forming the vehicle system 102. The energy management system 156 and/or the operator can generate several potential builds of the vehicle system 102. The energy management system 156 can calculate the quantified evaluations of the potential builds and present the quantified evaluations to the operator. The operator may then change one or more of these potential builds (or otherwise create a new potential build), and the energy management system 156 can calculate the quantified evaluation(s) for the edited and/or new potential builds. This process can iteratively repeat until the operator selects one of the potential builds, or until the energy management system 156 automatically selects a potential build (e.g., when the metrics or weighted metrics associated with a potential build all exceed one or more designated thresholds).

If a potential build has been automatically or manually selected, then the control system 150 can operate to cause the vehicle system 102 to be formed according to the selected potential build. As a result, flow of the method 700 can proceed toward 714. But, if no potential build is selected, then the control system 150 may need to determine one or more other potential builds for evaluation. For example, the combination of vehicles 104, 108 in the various potential builds may result in unacceptable safety metrics (e.g., the potential builds are too unsafe to travel), unacceptable consumption metrics (e.g., the potential builds do not have the ability to carry enough fuel to complete the trip), and/or unacceptable build times (e.g., the times needed to form the vehicle system 102 according to the different potential builds would prevent the vehicle system 102 from departing from the vehicle yard on schedule). If no potential build is selected, then flow of the method 700 can return toward 704 to determine one or more additional potential builds that are different from the previously examined potential builds. Alternatively, flow of the method 700 can terminate.

At 714, the vehicle system is built according to the selected potential build. In one embodiment, the control system 150 can provide the operator with the sequential order of the vehicles 104, 108 in the selected potential build (e.g., via the user interface 306, via printed copy, or the like), and the operator can control or direct the control of the equipment 802, 804 and the vehicles 104, 108 to form the vehicle system 102 in the vehicle yard according to the selected build. Optionally, the control system 150 can generate control signals that direct the equipment 802, 804 and/or the vehicles 108 to automatically form the vehicle system 102 according to the selected build. The control signals can direct the equipment 802 to automatically push or pull vehicles 104 into positions in the vehicle yard according to the selected build. The control signals can direct the equipment 804 to automatically lift, move, and/or place cargo and/or vehicles 104 into positions in the vehicle yard according to the selected build. The control signals can direct the vehicles 108 to automatically propel themselves to positions in the vehicle yard according to the selected build.

The vehicles 104, 108 can be placed into the sequential order of the selected build and, if the vehicles 104, 108 are to be mechanically coupled with each other, the vehicles 104, 108 can become connected with each other. The vehicle system 102 may then be formed in accordance with the selected build, and can depart on the trip. If the vehicles 108 are to be separate from each other (e.g., not directly or indirectly mechanically coupled with each other), the vehicles 108 can establish communication links with each other to allow the vehicles 108 to communicate and coordinate their movements with each other as the vehicle system 102. The vehicle system 102 may then be formed in accordance with the selected build, and can depart on the trip.

One or more embodiments of the subject matter described herein can provide for increased safety, reduced fuel consumption, and/or reduced build time for forming a multi-vehicle system 102 relative to currently implemented methods for deciding how to form the vehicle systems 102. Currently, rules of thumb or other heuristic rules are used to determine how to form a vehicle system 102. For example, an operator of a vehicle yard may direct the forming of a vehicle system 102 according to a first order of the vehicles 104, 108 that includes a vehicle 104 carrying hazardous material. The operator may restrict movement of the vehicle system 102 to always move below a speed limit (that is slower than the speed limit of a route) to ensure the safe movement of the vehicle system 102. But, the same vehicle system 102 with the same vehicles 104, 108 (including the vehicle 104 carrying hazardous material) may be built with the vehicles 104, 108 in a different, second order. This different order can result in an improved safety metric (relative to the first order) due to the inter-vehicle forces being reduced in the vehicle system 102 (relative to the first order of vehicles 104, 108). This may allow for the vehicle system 102 formed according to the second build order to travel at faster speeds than if the vehicle system 102 was formed according to the first build order due to the reduced inter-vehicle forces in the vehicle system 102 formed according to the second build order.

In one embodiment, a method includes identifying vehicles to be included in a multi-vehicle system that is to travel along one or more routes for an upcoming trip, determining plural different potential builds of the multi-vehicle system, the different potential builds representing different sequential orders of the vehicles in the multi-vehicle system, simulating travels of the different potential builds of the multi-vehicle system over the one or more routes of the upcoming trip, calculating one or more safety metrics, consumption metrics, or build metrics for the different potential builds of the multi-vehicle system based on travels of the different potential builds that are simulated, and generating a quantified evaluation of the one or more safety metrics, consumption metrics, or build metrics for the different potential builds of the multi-vehicle system for use in selecting a chosen potential build of the different potential builds, wherein the chosen potential build is used to build the multi-vehicle system for the upcoming trip.

Optionally, the different potential builds of the multi-vehicle system differ from each other in that the different potential builds include one or more of different numbers of propulsion-generating vehicles of the vehicles in the multi-vehicle system, different locations of the propulsion-generating vehicles in the multi-vehicle system, different numbers of non-propulsion-generating vehicles of the vehicles in the multi-vehicle system, and/or different locations of the non-propulsion-generating vehicles in the multi-vehicle system.

Optionally, the different potential builds of the multi-vehicle system differ from each other in that the different potential builds include different locations of combined blocks of the non-propulsion-generating vehicles in the multi-vehicle system. The non-propulsion-generating vehicles included in each of the combined blocks can remain constant across or through the different potential builds of the multi-vehicle system.

Optionally, simulating travel of the different potential builds of the multi-vehicle system includes calculating the one or more safety metrics, consumption metrics, or build metrics based on a trip plan for the upcoming trip that designates one or more operational settings of the different potential builds of the multi-vehicle system at one or more of different locations along the one or more routes, different distances along the one or more routes, or different times during the upcoming trip.

Optionally, the safety metrics are calculated for the different potential builds of the multi-vehicle system. The safety metrics can represent inter-vehicle forces that are calculated for the different potential builds in the travels that are simulated.

Optionally, the safety metrics are calculated as the inter-vehicle forces exerted on couplers that mechanically connect the vehicles in the different potential builds in the travels that are simulated. The inter-vehicle forces can be calculated during one or more of tractive power applied at an upper designated power limit or braking effort applied at an upper designated braking limit during the travels that are simulated.

Optionally, the consumption metrics are calculated for the different potential builds of the multi-vehicle system. The consumption metrics can represent amounts of one or more of fuel or energy calculated as being consumed by the different potential builds of the multi-vehicle system in the travels that are simulated.

Optionally, the consumption metrics are calculated based on one or more of different wind drag forces that are calculated as being exerted on the different potential builds of the multi-vehicle system in the travels that are simulated, different sizes of the different potential builds of the multi-vehicle system in the travels that are simulated, different weights of the different potential builds of the multi-vehicle system in the travels that are simulated, different numbers of propulsion-generating vehicles of the vehicles in the different potential builds of the multi-vehicle system in the travels that are simulated, or different locations of the propulsion-generating vehicles of the vehicles in the different potential builds of the multi-vehicle system in the travels that are simulated.

Optionally, the build metrics are calculated for the different potential builds of the multi-vehicle system. The build metrics can represent amounts of time needed to couple the vehicles together in a vehicle yard according to the different potential builds for the travels that are simulated.

Optionally, the build metrics are calculated from a yard database storing one or more of availabilities of propulsion-generating vehicles of the vehicles in the vehicle yard, locations of the vehicles in the vehicle yard, availabilities of equipment in the vehicle yard to move the vehicles in yard routes in the vehicle yard to form the different potential builds, availabilities of different yard routes within the vehicle yard, scheduled departure times of the vehicles from the vehicle yard, or scheduled maintenance of one or more of the vehicles in the vehicle yard.

Optionally, determining the different potential builds of the multi-vehicle system includes receiving one or more user-selected different potential builds of the multi-vehicle system, and generating the quantified evaluation can include presenting the quantified evaluation to a user, receiving a user modification of one or more of the user-selected different potential builds, simulating travels of the one or more user-selected different potential builds that are modified, calculating one or more safety metrics, consumption metrics, or build metrics for the one or more user-selected different potential builds that are modified, and generating an updated quantified evaluation of the one or more user-selected different potential builds.

In one embodiment, a system includes one or more processors configured to identify vehicles to be included in a multi-vehicle system that is to travel along one or more routes for an upcoming trip. The one or more processors also are configured to determine plural different potential builds of the multi-vehicle system. The different potential builds represent different sequential orders of the vehicles in the multi-vehicle system. The one or more processors are configured to calculate one or more safety metrics, consumption metrics, or build metrics for the different potential builds of the multi-vehicle system based on simulated travels of the different potential builds. The one or more processors also are configured to generate a quantified evaluation of the one or more safety metrics, consumption metrics, or build metrics for the different potential builds of the multi-vehicle system for use in selecting a chosen potential build of the different potential builds. The chosen potential build is used to build the multi-vehicle system for the upcoming trip.

Optionally, the different potential builds of the multi-vehicle system differ from each other in that the different potential builds include one or more of different numbers of propulsion-generating vehicles of the vehicles in the multi-vehicle system, different locations of the propulsion-generating vehicles in the multi-vehicle system, different numbers of non-propulsion-generating vehicles of the vehicles in the multi-vehicle system, or different locations of the non-propulsion-generating vehicles in the multi-vehicle system.

Optionally, the one or more processors are configured to calculate the safety metrics for the different potential builds of the multi-vehicle system. The safety metrics can represent inter-vehicle forces that are calculated for the different potential builds in the travels that are simulated.

Optionally, the one or more processors are configured to calculate the consumption metrics for the different potential builds of the multi-vehicle system. The consumption metrics can represent amounts of one or more of fuel or energy calculated as being consumed by the different potential builds of the multi-vehicle system in the travels that are simulated.

Optionally, the one or more processors are configured to calculate the build metrics for the different potential builds of the multi-vehicle system. The build metrics can represent amounts of time needed to couple the vehicles together in a vehicle yard according to the different potential builds for the travels that are simulated.

In one embodiment, a method includes identifying vehicles to be included in a multi-vehicle system that is to travel along one or more routes for an upcoming trip, and determining plural different potential builds of the multi-vehicle system. The different potential builds represent different sequential orders of the vehicles in the multi-vehicle system. The method also includes calculating one or more safety metrics, consumption metrics, or build metrics for the different potential builds of the multi-vehicle system based on simulated travel of the different potential builds, and generating a quantified evaluation of the one or more safety metrics, consumption metrics, or build metrics for the different potential builds of the multi-vehicle system for use in selecting a chosen potential build of the different potential builds. The chosen potential build is used to build the multi-vehicle system for the upcoming trip.

Optionally, the different potential builds of the multi-vehicle system differ from each other in that the different potential builds include one or more of different numbers of propulsion-generating vehicles of the vehicles in the multi-vehicle system, different locations of the propulsion-generating vehicles in the multi-vehicle system, different numbers of non-propulsion-generating vehicles of the vehicles in the multi-vehicle system, or different locations of the non-propulsion-generating vehicles in the multi-vehicle system.

Optionally, the safety metrics are calculated for the different potential builds of the multi-vehicle system. The safety metrics can represent inter-vehicle forces that are calculated for the different potential builds in the travel that is simulated.

Optionally, the consumption metrics are calculated for the different potential builds of the multi-vehicle system. The consumption metrics represent amounts of one or more of fuel or energy calculated as being consumed by the different potential builds of the multi-vehicle system in the travel that is simulated.

Optionally, the build metrics are calculated for the different potential builds of the multi-vehicle system. The build metrics can represent amounts of time needed to couple the vehicles together in a vehicle yard according to the different potential builds for the travel that is simulated.

Optionally, one or more embodiments herein described provide systems and methods for determining which portions and/or components of routes on which vehicle systems travel are to be modified prior to or in place of other portions and/or components of the routes. Several sections of routes, bridges, tunnels, etc. may be need modification such as repair and/or upgrades. For example, segments of rail may need to be straightened or replaced, potholes or cracks may need to be filled, bridges may need to be repaired or added, lanes may need to be added, etc. Resources for performing the needed modifications, however, may be limited so that not all modifications can be completed at the same time or within the same time period (e.g., within the current or next calendar quarter, the current or next calendar year, the current or next time period associated with a budget for performing the modifications). The many vehicle systems may be forced to travel more slowly through or over these route portions and/or components that need modification (e.g., slower than speed limits in place before the need for modification began). For example, temporary slower speed limits (referred to herein as slow orders) may be in place to cause vehicles to travel much more slowly through or over these route portions and/or components than before. As another example, some vehicle systems may not be permitted to travel over or through the route portions and/or components in need of modification. These vehicle systems may be forced or required to travel over or through other route portions and/or components until the portions and/or components in need of modification are modified. The slow orders or detours can significantly restrict the flow of vehicle systems through a transportation network formed of routes. This can negatively impact the throughput of vehicle systems, cargo, and passengers.

One embodiment of the inventive subject matter described herein examines the impact of performing modifications on one or more selected route portions and/or components rather than one or more other non-selected route portions and/or components on the throughput of vehicle systems through the transportation network. For example, given an amount of resources that are currently available for route modification and/or maintenance and that are smaller than the amount needed for modification or maintenance of all route portions and/or components, the inventive systems and methods can determine which route portions and/or components should be modified to increase the throughput more than modifying other route portions and/or components.

In one embodiment, the vehicle yards 200 shown in FIG. 1 can represent portions or components of routes in need of modification or maintenance. For example, instead of or in addition to reference number 200 representing vehicle yards in FIG. 1, reference number 200 can represent bridges, route sections, tunnels, or the like. In addition to or as an alternate to the energy management system 156 determining and simulating travel of different vehicle systems 102 (as described above), the energy management system 156 can simulate travel of the vehicle systems 102 over the routes when different route portions and/or components 200 are modified instead of other route portions and/or components 200. The route portions and/or components 200 are referred to herein as route components.

For example, the condition of one or more route components can be obtained by the energy management system from the characterization elements, as described above. The condition of some of the route components may indicate a need for modification or maintenance. As a result, the energy management system may determine or be informed (by the characterization elements and/or operator input) which route components need modification. The energy management system also may obtain or be informed with the amount of resources that are available to modify the route components, how many of the route components can be modified with the currently available resources, and/or which route components can be modified with the currently available resources. The resources can be financial assets usable to pay for the modifications, man-hours available to perform the modifications, amount of materials used to perform the modifications, and/or equipment that is used to perform the modifications. The available resources can be provided by an operator and/or the load estimator described herein.

Each route component may be associated with a modification cost that is an estimate of how much of the resources is needed to modify the route component. This modification cost can be input to the energy management system by an operator or the characterization elements. Optionally, a default estimate of the cost can be used based on the type or category of route component. For example, modification of a bridge may be associated with a default cost that is greater than modification of a road.

The energy management system can determine different combinations of the route components that can be modified based on the available resources for modification. The energy management system can simulate travel of the vehicle systems according to the movement plan with several or all of these different combinations of modified route components. Each combination of modified route components can be limited so that the total cost of estimated modifications of the modified route components is no greater than the available resources for modification. For example, the total financial cost of the modifications, the total amount of man hours to be used for the modifications, the total amount of available materials for the modifications, and/or the total amount of equipment to be used for the modifications in a combination must be no greater than the available resources. Otherwise, the combination may not be used for simulated travel.

The energy management system can then simulate travel of the vehicle systems according to the movement plan for several or all of the different combinations of modifications. As described above, movement of vehicle systems may be restricted due to unmodified route components, such as by requiring the vehicle systems to slow down or avoid travel via the unmodified route components. The energy management system can determine the throughput parameters for the simulated travels of the vehicle systems for the different combinations of modifications. The energy management system can select the combination of modifications associated with the greatest throughput parameter (or the throughput parameter that is greater than one or more, but not all, other throughput parameters). This selected combination of modifications can then be provided or output to another location. For example, the selected modification combination can be presented to an operator, communicated to repair equipment or personnel, or the like. The selected modification combination is then used to modify the route components associated with the selected modification combination. This can ensure that the available resources are used to select which route components to modify (when not all components can be modified) for the greatest impact on traffic in the transportation network.

In one embodiment, a method includes determining (using one or more processors) route components in need of modification within a transportation network, determining (using the one or more processors) an amount of available resources to complete modification of one or more of the route components, and determining (using the one or more processors) different combinations of modifications to one or more of the route components. Each of the different combinations of modifications is associated with modification costs that are no greater than the amount of available resources. The method also includes simulating (using the one or more processors) travel of one or more vehicle systems in the transportation network according to the different combinations of modifications and selecting at least one of the different combinations of modifications as a selected modification combination. One or more of the route components are modified according to the selected modification combination.

Optionally, the route components include one or more bridges, sections of road, sections or track, or tunnels.

Optionally, simulating the travel of the one or more vehicle systems in the transportation network according to the different combinations of modifications includes restricting one or more of a speed at which the one or more vehicle systems move through or over one or more of the route components that are not modified in the combination of modifications associated with the travel that is simulated or available routes for travel on which the one or more vehicle systems move in the combination of modifications associated with the travel that is simulated.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

identifying, with one or more processors, vehicles to be included in a vehicle system that is to travel along one or more routes for an upcoming trip;

determining, with the one or more processors, plural different builds of the vehicle system with at least some of the vehicles;

simulating, with the one or more processors, travels of the different builds of the vehicle system over the one or more routes of the upcoming trip; and generating, with the one or more processors, a quantified evaluation of one or more safety metrics, consumption metrics, or build metrics for the different builds of the vehicle system for use in selecting a chosen build of the different builds, wherein the chosen build is used to build the vehicle system for the upcoming trip.

2. The method of claim 1, wherein the different builds of the vehicle system include one or more of:

different numbers of propulsion-generating vehicles of the vehicles in the vehicle system, different locations of the vehicles in the vehicle system, or different numbers of non-propulsion-generating vehicles of the vehicles in the vehicle system.

3. The method of claim 1, wherein the different builds of the vehicle system include different locations of combined blocks of non-propulsion-generating vehicles of the vehicles in the vehicle system, wherein the non-propulsion-generating vehicles included in each of the combined blocks remain constant across or through the different builds of the vehicle system.

4. The method of claim 1, wherein simulating travel of the different builds of the vehicle system includes calculating the one or more safety metrics, consumption metrics, or build metrics based on a trip plan for the upcoming trip, the trip plan designating one or more operational settings of the different builds of the vehicle system for one or more of different locations, different distances along the one or more routes, or different times.

5. The method of claim 1, wherein the safety metrics represent inter-vehicle forces.

6. The method of claim 5, wherein the safety metrics represent the inter-vehicle forces exerted on couplers that mechanically connect the vehicles in the different builds.

7. The method of claim 1, wherein the consumption metrics represent amounts of one or more of fuel or energy calculated as being consumed by the different builds of the vehicle system.

8. The method of claim 7, wherein the consumption metrics are based on one or more of wind drag forces, different sizes of the different builds of the vehicle system, different weights of the different builds of the vehicle system, different numbers of propulsion-generating vehicles of the vehicles in the different builds of the vehicle system, or different locations of the propulsion-generating vehicles of the vehicles in the different builds of the vehicle system.

9. The method of claim 1, wherein the build metrics represent amounts of time needed to form the different builds of the vehicle system.

10. The method of claim 1, wherein determining the different builds of the vehicle system includes receiving one or more user-selected builds of the vehicle system, wherein generating the quantified evaluation includes:

presenting the quantified evaluation to a user, receiving a user modification of one or more of the user-selected builds, simulating travel of the one or more user-selected builds that are modified, and generating an updated quantified evaluation of the one or more user-selected builds.

11. A system comprising:

one or more processors configured to determine vehicles to be included in a vehicle system that is to travel along one or more routes for an upcoming trip and to determine plural different builds of the vehicle system with at least some of the vehicles, the one or more processors also configured to simulate travels of the different builds of the vehicle system over the one or more routes of the upcoming trip and to generate a quantified evaluation of one or more safety metrics, consumption metrics, or build metrics for the different builds of the vehicle system for use in selecting a chosen build of the different builds, wherein the chosen build is used to build the vehicle system for the upcoming trip.

12. The system of claim 11, wherein the different builds of the vehicle system include one or more of:

different numbers of propulsion-generating vehicles of the vehicles in the vehicle system, different locations of the vehicles in the vehicle system, or different numbers of non-propulsion-generating vehicles of the vehicles in the vehicle system.

13. The system of claim 11, wherein the different builds of the vehicle system include different locations of combined blocks of non-propulsion-generating vehicles of the vehicles in the vehicle system, wherein the non-propulsion-generating vehicles included in each of the combined blocks remain constant across or through the different builds of the vehicle system.

14. The system of claim 11, wherein the one or more processors are configured to simulate travel of the different builds of the vehicle system by calculating the one or more safety metrics, consumption metrics, or build metrics based on a trip plan for the upcoming trip, the trip plan designating one or more operational settings of the different builds of the vehicle system for one or more of different locations, different distances along the one or more routes, or different times.

15. The system of claim 11, wherein the safety metrics represent inter-vehicle forces.

16. The system of claim 15, wherein the safety metrics represent the inter-vehicle forces exerted on couplers that mechanically connect the vehicles in the different builds.

17. The system of claim 11, wherein the consumption metrics represent amounts of one or more of fuel or energy calculated as being consumed by the different builds of the vehicle system.

18. A method comprising:

determining, using one or more processors, route components in need of modification within a transportation network;

determining, using the one or more processors, an amount of available resources to complete modification of one or more of the route components;

determining, using the one or more processors, different combinations of modifications to one or more of the route components, each of the different combinations of modifications associated with modification costs that are no greater than the amount of available resources;

simulating, using the one or more processors, travel of one or more vehicle systems in the transportation network according to the different combinations of modifications; and selecting at least one of the different combinations of modifications as a selected modification combination, wherein one or more of the route components are modified according to the selected modification combination.

19. The method of claim 18, wherein the route components include one or more bridges, sections of road, sections or track, or tunnels.

20. The method of claim 18, wherein simulating the travel of the one or more vehicle systems in the transportation network according to the different combinations of modifications includes restricting one or more of:

a speed at which the one or more vehicle systems move through or over one or more of the route components that are not modified in the combination of modifications associated with the travel that is simulated, or available routes for travel on which the one or more vehicle systems move in the combination of modifications associated with the travel that is simulated.

* * * * *